US005507491A

United States Patent [19]

Gatto et al.

[11] Patent Number: 5,507,491

[45] Date of Patent: Apr. 16, 1996

[54] GAMING TERMINAL

[75] Inventors: Jean-Marie Gatto; Dominique Bertrand, both of Paris, France

[73] Assignee: Internationale Des Jeux, Boulogne, France

[21] Appl. No.: 124,623

[22] Filed: Sep. 22, 1993

[30] Foreign Application Priority Data

Sep. 22, 1992 [FR] France ..... 92 11275

[51] Int. Cl.[6] ..... A63B 71/00; A63F 1/00; A63F 1/18

[52] U.S. Cl. ..... 273/139; 273/138 A

[58] Field of Search ..... 235/27, 375, 454, 235/455, 465, 469; 364/410, 411, 412; 382/17; 273/138 A, 138, 139

[56] References Cited

FOREIGN PATENT DOCUMENTS 2180460 4/1987 United Kingdom .

2226252 6/1990 United Kingdom .

WO82/02968 9/1982 WIPO .

*Primary Examiner*—David M. Huntley

*Assistant Examiner*—Stephen R. Tkacs

*Attorney, Agent, or Firm*—Sterne, Kessler, Goldstein & Fox

[57] ABSTRACT

A gaming terminal for use with information carriers, such as gaming coupons and receipts. The gaming terminal comprises an information analyzer including an information processor for converting the information read from the carriers into digital data and for transmitting the data to a remote processing system, a dividable nonvolatile memory system for storing terminal instructions received from the remote processing system and for storing gaming data received by the terminal, a data receiver for accepting carrier validation data originating from the processing system, a data display, a keyboard, and a terminal processor. The information analyzer further comprises a single analysis device having the facility to analyze hand-written signs or marks scribed on the coupons by a player and the facility to read bar codes representing validation numerals on the receipts.

13 Claims, 17 Drawing Sheets

GAMING TERMINAL

BACKGROUND OF THE INVENTION

1. Field of the Invention

The present invention relates to terminals for games organized on a national scale, such as lottery games, lotto totalizers or the like.

2. Related Art

Such terminals generally form part of systems for placing bets.

A system for placing bets generally includes terminals for placing bets located in gaming offices visited by the players who deposit at these offices gaming coupons which they have completed, together with the handing-over of a sum of money corresponding to the stake which they wager.

In exchange they receive a receipt which they keep until the draw.

The bet-placing terminals are either linked by a communication network to a central processing system or server centre and are so-called "on line" terminals, or autonomous so-called "off line" terminals.

The gaming terminals are ordinarily equipped with devices for analyzing gaming coupons and often with separate devices for analysing receipts for determining, after the draw, the bearers of receipts who should receive winnings, together with the amounts of these winnings.

The processing of a gaming coupon is carried out by inserting this coupon into a coupon analysis device of a terminal.

This coupon is analysed in pixels and the image obtained is processed digitally.

The aforesaid processing determines the type of coupon, the type of marks or signs written on the coupon by the players, and prepares a coded frame which is transmitted to the central processing system which records the corresponding transaction in a memory.

Once the transaction is recorded, a validation code is sent to the terminal which prints a receipt which marks the commitment of the gaming body towards the player of payment in the event of a win.

The terminal furthermore includes means for analyzing the receipt after the draw in order to determine whether the bearer of the receipt has won or not.

After reading the receipt, the coded numeral which it bears is transmitted by the terminal to the central system which interrogates the file of winners.

If the numeral of the receipt in question appears in the file, permission for payment is transmitted to the corresponding terminal.

SUMMARY OF THE INVENTION

The invention aims to enhance the existing gaming terminals by creating a gaming terminal which provides for the greatest number of functions mentioned above while still offering the most compact, modular construction possible and the simplest and safest possible manner of use.

It also aims to produce a terminal whose construction and use offer major possibilities for development over time.

The subject of the invention is therefore a gaming terminal comprising means for analyzing information carriers, especially gaming coupons and receipts, means for processing the information resulting from the analysis of the information carriers, for converting these data into digital data and for transmitting these data to a remote or local processing system by way of a communication network, means for receiving data for validating gaming coupons and/or receipts originating from the remote or local processing system, data display means, a keyboard assembly associated with electronic means for controlling the various functions of the terminal characterized in that the means for analyzing the gaming coupons and receipts consist of a common information carrier analysis device comprising means for analyzing the signs written by the players on the coupons and means for reading bar codes representing the validation numerals of the receipts and in that these processing means include large-capacity, dividable storage means having zero retention energy consumption, on the one hand for the instructions for operating the terminal which are transmitted to them from the processing system, and on the other hand for the gaming data received by the terminal and in that it furthermore includes integrated-circuit passkey means for permitting or prohibiting access to the terminal.

According to a particular characteristic of the invention, the storage means consist of at least one so-called "flash" segmented EEPROM memory.

According to another characteristic of the invention, the terminal furthermore includes a device for reading magnetic codes and optical codes, which is associated with the device for analyzing information carriers.

According to yet another characteristic of the invention, the terminal furthermore includes an integrated-circuit card reader associated with the information carrier analysis device.

BRIEF DESCRIPTION OF THE FIGURES

The invention will be better understood with the aid of the description which will follow, given merely by way of example and provided with reference to the attached drawings, in which.

DETAILED DESCRIPTION OF THE PREFERRED EMBODIMENTS

Figure 1:
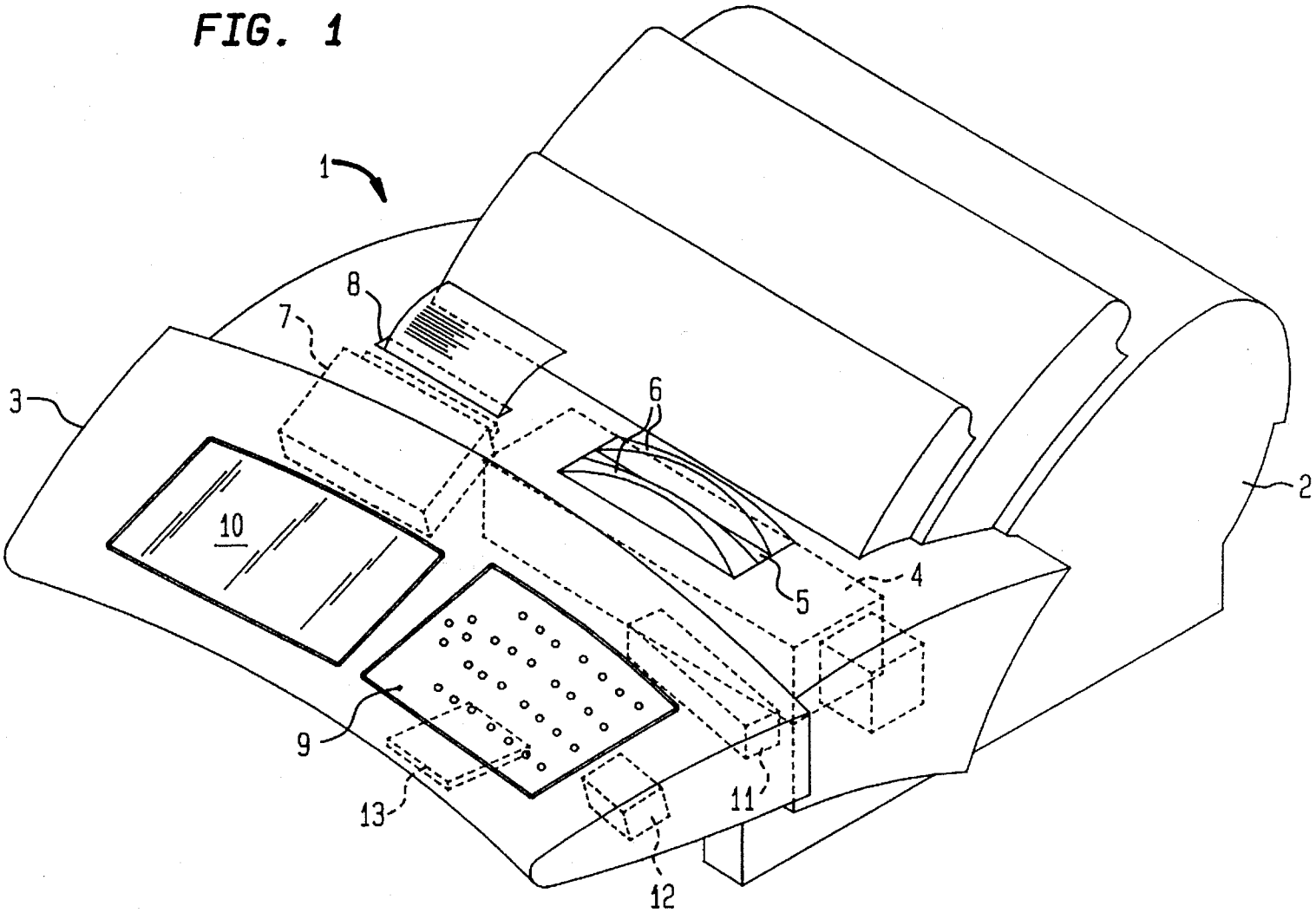
FIG. 1 is a general perspective view of a gaming terminal according to the invention.

Represented in perspective in FIG. 1 is a general outside view of the gaming terminal according to the invention.

This terminal, designated by the general reference 1, includes a rear housing 2 in which are placed most of the electronic circuits of the terminal and a front housing 3 essentially containing the means for actuation and for display for the terminal. The housing 2 contains an essential element of the terminal of the invention, namely a device 4 for analyzing data carriers.

For access to the analysis device 4, the housing includes a slot 5 delimited by lips 6 made from the same material as the housing 2.

To the side of the data carrier analysis device 4, the housing 2 contains a printer 7 equipped with a cutter device, such as a thermal printer, above which is made a slot 8 provided in the housing 2 to enable printed documents to exit.

The various components of the terminal which are contained in the housing 2, together with those contained in the housing 3, are represented dotted.

The housing 3 situated in front of the housing 2 includes a control keyboard 9 which will be described in further detail later on, a display screen 10 of the liquid-crystal type intended to display the information corresponding to the current running of commands for operating the terminal, a magneto-optical reader 11 intended for reading carriers bearing magnetic codes, and carrier bearing optical codes, a housing 12 with integrated-circuit passkey intended for monitoring access to the terminal in a way which will be described later and a reader 13 of integrated-circuit cards, especially monetary credit cards or gambling credit cards.

Figure 2:
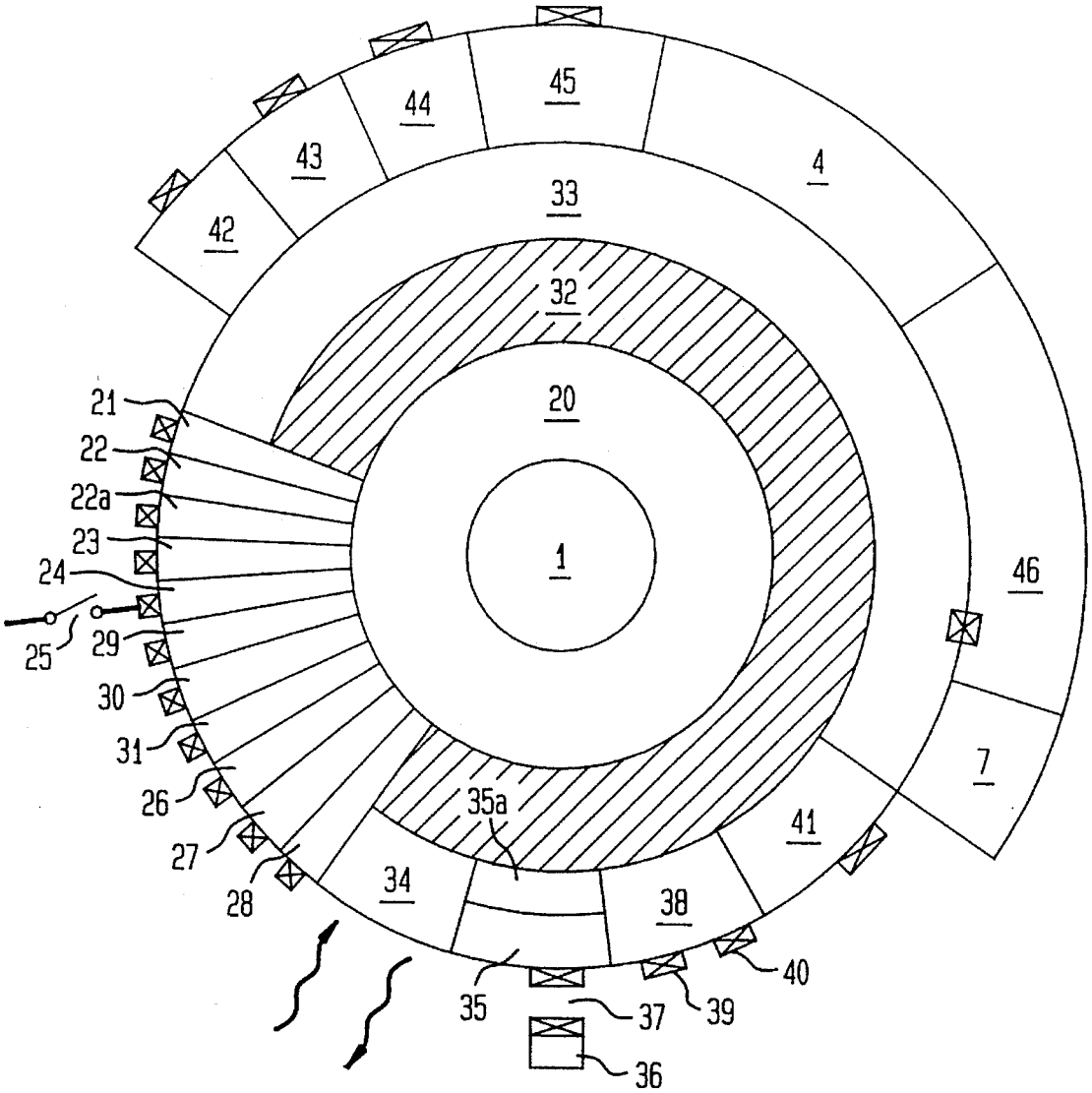
FIG. 2 is a schematic diagram of the gaming terminal of FIG. 1.

Represented in FIG. 2 is a schematic diagram of the gaming terminal according to the invention.

This schematic diagram of a particular type should be read starting from the center whereat is indicated the general function of the device described, towards the periphery, by successive concentric layers which provide progressively more detailed indications about the structure of the device.

The terminal 1 represented diagrammatically in FIG. 2 includes, firstly, an off-the-shelf microprocessor card 20, such as a 386 SX card from Intel Corporation, 3065 Bower Avenue, Santa Clara, Calif. 95052.

This card 20 includes two serial input output circuits 21, 22, a parallel input output circuit **22*a*, a circuit 23 for connecting to a color graphics screen, a circuit 24 connected up to a switch 25 for selecting the operating speed of the terminal, a circuit 26 for linking to the keyboard 9, a loudspeaker output circuit 27 and a logic circuit for resetting 28. It furthermore includes circuits 29, 30 and 31** which can be used for connecting a hard disk, a diskette and an external microcomputer card.

The ports for linking all these circuits to the aforesaid peripheral devices are manifested in the figure with a square barred with a cross.

With the microprocessor 20 there is furthermore associated an ISA microcomputer bus 32 intended for linking the microprocessor 20 to a number of circuits and especially to a circuit or auxiliary card 33 containing an autonomous processing unit, a memory and a logic monitoring unit.

The microprocessor 20 is furthermore linked by the bus 32 to a modem 34 for linking to a communication network to which the terminal is connected, with a "flash" type EEPROM memory card 35. This integrated memory circuit is manufactured and sold by the Intel Corporation company. It is intended for storing, on the one hand, the terminal operating programs loaded therein from the central processing system to which it is linked by the network and, on the other hand, the gaming data received by the terminal proper.

This "flash" memory card 35 is associated with a "flash" memory card 36 which can be plugged in by means of a connector 37 and is intended to contain for example the gaming data gathered by the terminal over a given period. This memory card 36 can be withdrawn from the terminal so as to be transported to a processing centre. The "flash" type memories have the essential characteristics of being extremely difficult to access, if the appropriate means are not available, so that the transporting in such a memory of data relating to games which are to remain secret prior to the draw is much safer than the transporting of data for example in a memory of the diskette type which may be read extremely easily with the aid of an ordinary microcomputer.

The microprocessor 20 is furthermore connected up by the bus 32 to a circuit 38 for connecting to a local network having a coaxial cable connection 39 and a twisted pair connection 40.

The microprocessor 20 is moreover connected by the bus 32 to an interface circuit 41 intended for linking together mass storage units. This is a parallel local bus, of multimedia type, for example SCSI. The interface circuit 41 enables a multi-media CD-ROM reader to be linked to the terminal.

The auxiliary card 33 is linked to two serial input/output circuits 42, 43, to a circuit 44 for monitoring the opening or closing of a cash till, to a circuit 45 for monitoring the electrical supply to the terminal, this circuit 45 being described in further detail with reference to FIG. 6, to the data analysis device 4 represented in FIG. 1, to an input/output circuit 46 associated with the keyboard 9 and to a circuit for controlling the thermal printer 7.

The electrical current supply to the terminal is provided for either at 110 volts, or at 220 volts AC from 40 to 80 Hz and delivers DC voltages of various values, −5 volts, +5 volts, −12 volts, +12 volts and +24 volts for example.

Thus, as will be seen later with reference to FIG. 6, all of the DC voltages with the exception of the 24-volt voltage, are controlled by the code of the coded passkey which the user of the terminal must possess in order to set it going.

Figure 3:
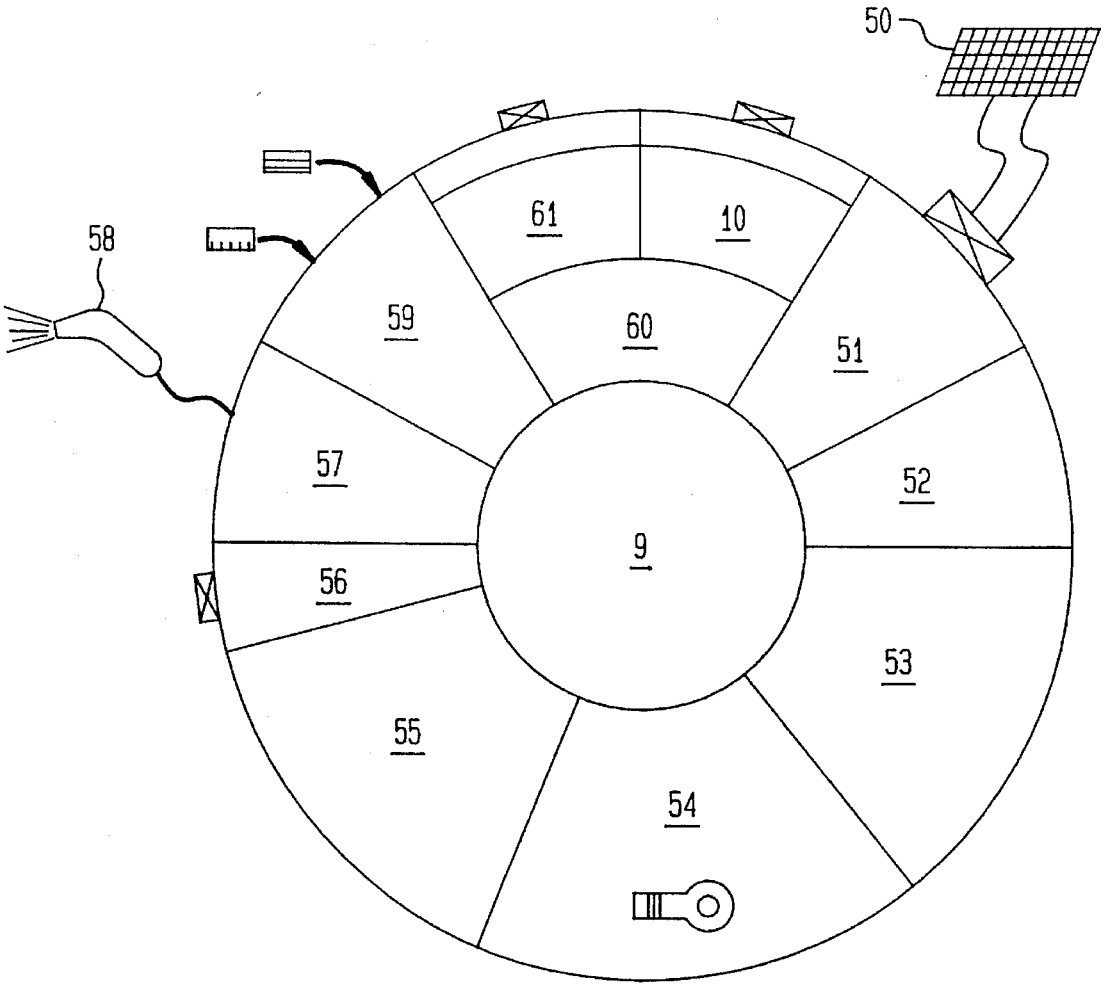
FIG. 3 is a detailed schematic diagram of the keyboard assembly of the gaming terminal according to the invention.

Represented in further detail in FIG. 3 is the assembly of the keyboard 9 controlled by the keyboard input/output circuit 36 of FIG. 2.

This keyboard assembly includes a matrix of keys associated with a monitoring circuit 51.

It furthermore includes a loudspeaker control circuit 52, a control circuit 53 associated with the integrated-circuit card or microchip card reader 13 (FIG. 1), a circuit 54 associated with the integrated-circuit passkey or microchip passkey assembly 12, a circuit 55 for controlling light-emitting signalling diodes (not depicted), and an interface circuit 56 with 50 connection pairs.

The keyboard assembly furthermore includes a circuit 57 for controlling an optical or magnetic reader 58 commonly termed a "douchette" and linked by a flexible cable to the keyboard assembly.

It also includes a circuit 59 for monitoring the magneto-optical reader 11 (FIG. 1) together with a circuit 60 for controlling, on the one hand, the liquid-crystal display screen of the terminal intended for the retailer and a liquid-crystal display device 61 intended for the players and linked to the terminal by a flexible cable, placed in such a way that the gamblers may see the result of their bet when their receipt is verified in the terminal following the draw of the game in which they participated.

Figure 5:
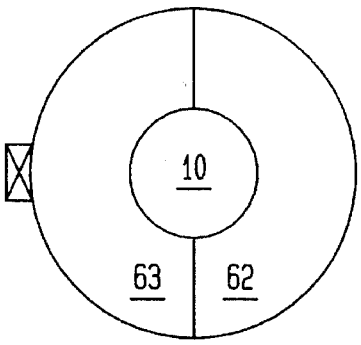

The liquid-crystal display device 10 intended for the retailer and represented in FIG. 5 includes a liquid-crystal display region 62 and a serial-parallel interface circuit 63.

Figure 4:
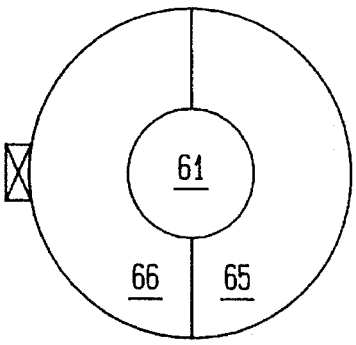
FIGS. 4 and 5 are more detailed diagrams of the display devices of the terminal.

Similarly, as represented in FIG. 4, the liquid-crystal display device intended for the players includes a liquid-crystal display region 65 and a serial-parallel interface circuit 66, the two display devices 10 and 61 being linked to the control circuit 60 by way of respective interface circuits 63 and 66.

Figure 6:
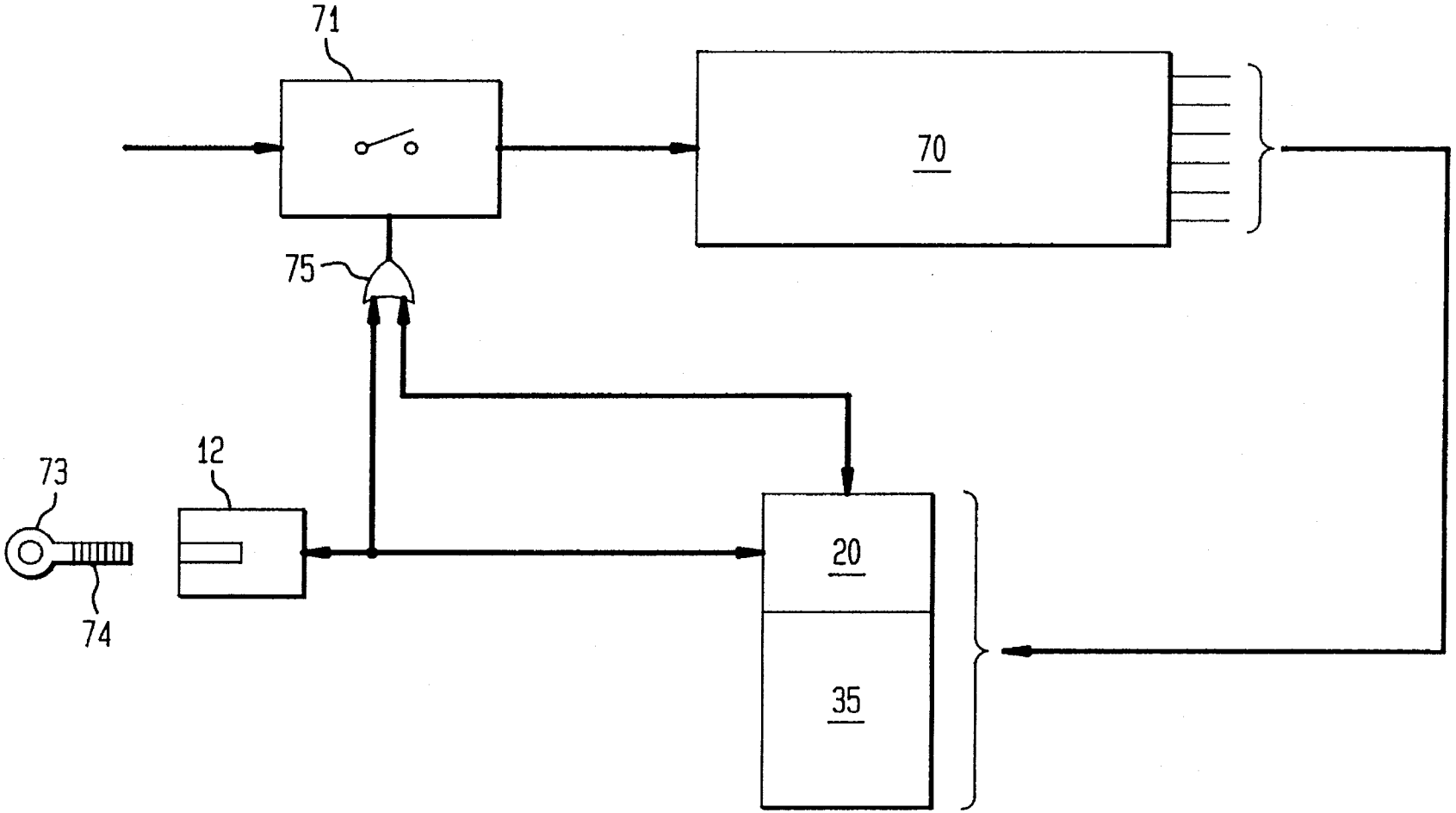
FIG. 6 is a schematic diagram of the device controlling the supply to the gaming terminal.

Reference will now be made to FIG. 6 wherein is represented the circuit 45 for monitoring the supply to the terminal according to the invention.

In this figure is seen the supply circuit 70 which is itself supplied from the 220 volts network by way of a switch 71 and which is intended to deliver at its output a number of DC voltages ranging from −5 volts to +12 volts for example, these various supply voltages being applied to the central processing unit of the microprocessor 20, to the memory assembly and in particular to the "flash" memory 35, to the auxiliary card 33 as well as to other circuits of the terminal.

Furthermore, the central unit of the microprocessor 20 is connected to the integrated-circuit passkey reading circuit 12 of a microchip passkey 73 which, as its name indicates, bears an integrated circuit 74 which contains the code for access to the terminal The output of the circuit 12 for reading the passkey 73 is furthermore connected to an input of an OR circuit 75, while the other input of the OR circuit is connected to a corresponding output of the central unit of the microprocessor 20. The output from the circuit 75 is intended to control the switch 71 for transmitting the voltage from the network to the supply circuit 70.

The insertion of the passkey 73 into the reader 12 firstly causes the appearance of an output signal applied, on the one hand, to the central unit 20 and, on the other hand, to the corresponding input of the OR circuit 75. If the output signal from the reader 12 corresponds to the exact code for access to the terminal, the central unit 20 recognizes this code and transmits on its output connected to the OR circuit 75 a signal causing the appearance at the output of the circuit 75 of a signal for controlling the closing of the switch 71 and consequently for turning on the supply 70. If, on the contrary, the output signal from the reader 12 corresponds to an erroneous access code, the central unit 20 transmits on its output connected to the corresponding input of the circuit 75, a signal providing for the turning-off of this circuit and consequently the opening of the switch 71 and the cutting of the network voltage applied to the supply 70.

Consequently, it is seen that the turning-on of the terminal is already conditional upon detecting the exact code or algorithm for access to the terminal written in the integrated circuit or microchip 74 of the passkey 73.

As described earlier with reference to FIG. 2, the circuit of the terminal includes a microprocessor card 20 comprising its own conventional memories with which is associated the flash memory 35 and the auxiliary card 33 also utilizes a memory.

The operation of the device as regards the behaviour of its storage means will therefore be described later.

The storage means associated with the central processing unit comprise a DRAM, the "flash" memory 35 intended to contain the coded and compressed software for the applications of the terminal, an SRAM and a ROM which are intended to contain fixed parameters such as internal tests, and basic transfer software.

According to the invention, it is desired to avoid, in respect of the flash memory 35, employing a hard disk which is expensive, slow, bulky and unreliable.

The memory 35 is therefore made in the form of a large-capacity segmented EEPROM having zero retention consumption and with which are associated specific access means **35*a* (FIG. 2**) enabling the memory to be placed in communication with the remainder of the terminal, with other terminals of the network or with units for loading/downloading and for reading/writing the flash memory.

During normal operation of the terminal, after switching on, there is a test to determine whether the memories of the terminal are loaded or empty.

If the memories are loaded, part of the DRAM is configured in virtual disk form, the remainder being configured as a work memory.

The files stored in the flash memory 35, in the SRAM and in the ROM are expanded, decoded and transferred either to the DRAM disk, or into the DRAM memory of the unit of the microprocessor 20.

Access to the flash memory is conditional upon the recognizing by the access means **35*a* of the access code contained in the integrated circuit 74 of the microchip passkey 73**.

The application to be carried out is then executed.

During the application, certain parameters are temporarily transferred to the SRAM, then during idle times of the application, the flash memory 35 is updated with the information contained in the SRAM.

The segmented structure of the flash memory 35 enables these operations to be executed in a minimum of time.

If the flash memory 35 and the SRAM and DRAM memories are empty, corresponding to the unloaded state of the terminal, when switching on, it is verified that there is no software in the aforesaid memories.

The terminal reads the ROM disk and basic transfer software contained in the ROM calls up the server center or is called by the latter which remotely loads into the flash memory 35 the applications to be executed by the terminal.

The latter is then ready to operate under normal operation.

The flash card 36 connected to the flash memory 35 by the connector 37 as represented diagrammatically in FIG. 2 also forms part of the operating diagram just described.

It can furthermore be withdrawn from the terminal and transported to a distant processing center without it being possible to access its contents.

This facility is very advantageous for terminals which do not operate in an interconnected network but whose gaming data would be read out specifically with the aid of a removable memory and transported to a processing center with a view to being processed there.

Returning now to FIG. 2 it should be pointed out that in the present embodiment, the data carrier analysis device 6 is advantageously of the type described in the French Patent Applications Nos. 92 10 642 of 7 Sep. 1992 and 92 11 112 of 17 Sep. 1992, which have been filed by the Applicant.

This is a device comprising means for inserting an information carrier, means for reading the information on the carrier, means for processing the information read on the carrier with a view to its conversion into digital data and its transmission to a central gaming management unit. The means for reading the information on the carrier, when the latter is a gaming coupon, comprise an optical reader which is blind to at least one color in which fixed information is printed on the carrier and which reader is sensitive to other colors, so as to take into account only the variable gaming information and the fixed information for aligning the carrier and for designating the type of game to which it belongs, which information is printed in these other colors.

Figure 7:
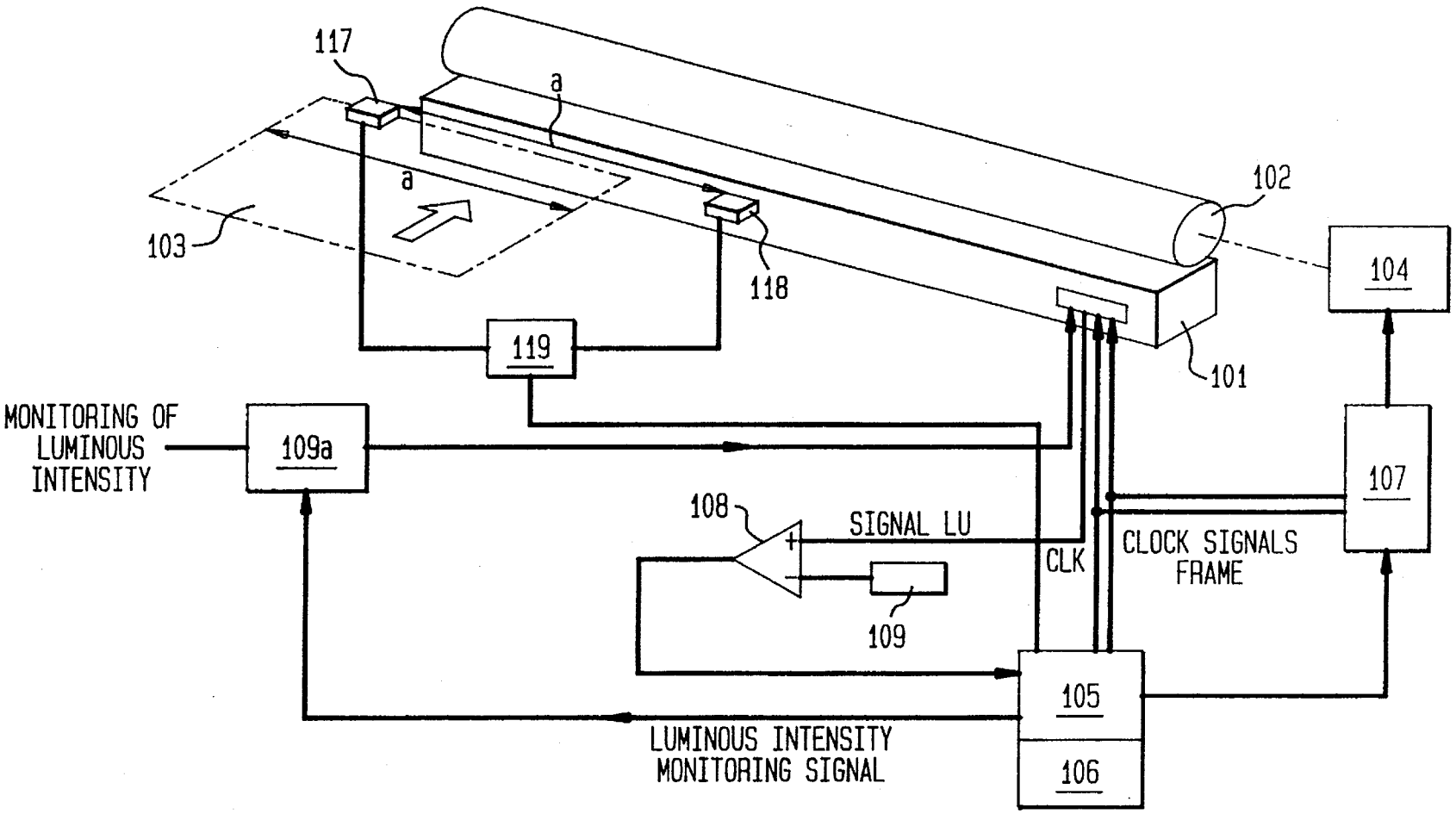
FIG. 7 is a perspective diagrammatic view of the analysis device forming part of the terminal.

The analysis device represented schematically in FIG. 7 includes principally an image detector 101 arranged opposite a roller 102 for driving a document 103 to be analysed.

The roller 102 is linked to an electric stepper motor 104 intended to allow analysis of the document 103 through successive scanning lines with a vertical resolution which depends on the step selected for the displacement of the roller 102.

Connected up to the image detector 101 is a data processing device 105 which includes a memory 106 for temporary storage of the digital image data, prior to its transmission to a central gaming management unit (not represented).

The device of FIG. 7 furthermore includes a logic circuit 107 for controlling the electric stepper motor 104 and a comparator 108 connected up between the data output of the image detector 101 and the input of the processing unit and intended to compare the output signal from the detector with a reference signal delivered by a signal source 109, as well as a circuit **109*a* for monitoring the luminous intensity which receives a luminous intensity monitoring signal originating from the processing unit 105**.

Thus, the processing unit 105 will be able, by comparison, to determine a correct intensity of the light source, appropriate to the processing in progress.

Figure 8:
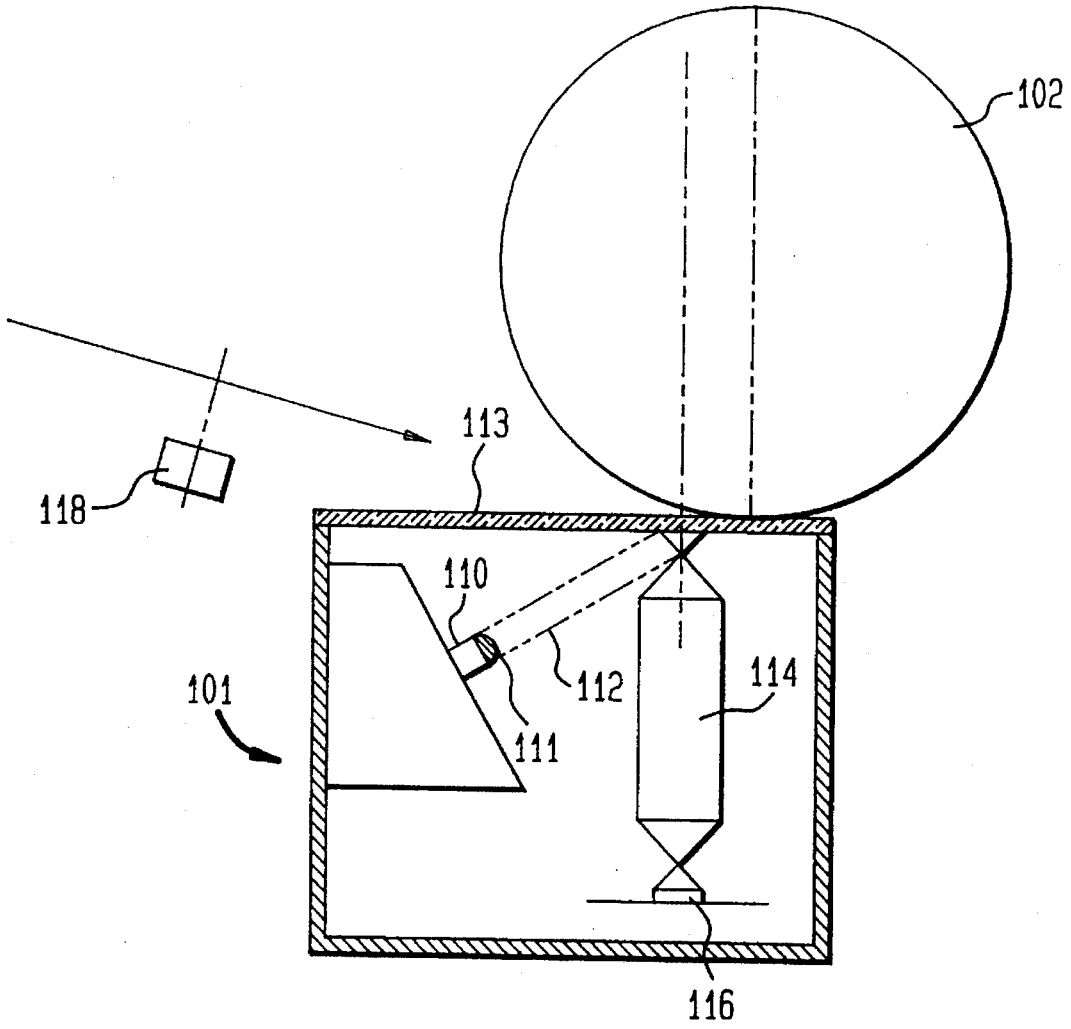
FIG. 8 is a diagrammatic view in transverse section of the device of FIG. 7.

As represented in FIG. 8, the image detector 101 includes a row of light-emitting diodes 110, the number of which depends on the horizontal resolution and luminous intensity which are required.

With these diodes 110 there are associated members 111 for focusing and filtering the light, and intended to focus these beams 112 onto a transparent wall 113 of the housing of the detector, against which wall must be applied the face of the document to be analysed which bears, on the one hand, fixed inscriptions such as a gaming grid, grid box numerals, date and other indications, printed in the color of the light emitted and which will therefore not be reproduced by the device and, on the other hand, variable inscriptions made by the player in the gaming grid in a color which differs from that of the emitted light, as well as fixed inscriptions such as alignment tags, a code relating to the type of game to which the coupon belongs, printed in a color which differs from that of the emitted light, and which will be reproduced.

Opposite the region for focusing the beams emitted by the light-emitting diodes 110, are arranged light conductors 114 for transmitting the beams to the photo-sensitive elements 116.

The plane of symmetry of the roller 102 and the optical axis of the light conductors 114 have a slight offset in the direction of insertion of a document in order to allow the front edge of this document to reflect the light emitted by the monochromatic light source, thereby conveying the presence of the document at this location.

Advantageously, the members 111 for focusing and filtering the beams emitted by the light-emitting diodes 110 are made in the form of thick plano-concave lenses whose concave face has a curvature such that the beam exiting a lens overlaps the beam exiting a neighboring lens.

Thus, the light emitted by the set of light-emitting diodes has the appearance of a continuous monochromatic luminous stroke of red color for example.

Thus, all the parts of a coupon printed in red do not appear on the image of the coupon as given by the device, while the parts printed or bearing marks in other colors do appear.

The device furthermore includes detectors 117, 118 arranged opposite the slot between the roller 102 and the image detector 101, at an axial distance from one another which is slightly greater than the transverse dimension a of the smallest document to be read.

The outputs of the detectors 117, 118 are connected up to the processing unit 105 through a circuit 119.

Such a layout makes it possible to distinguish between a document of small width, such as a receipt which prompts the actuation of a single detector, and a document of greater width, such as a gaming coupon which triggers two detectors, and to prompt within the processing unit 105 the intervention of a program appropriate to the processing of the corresponding document.

Figure 9:
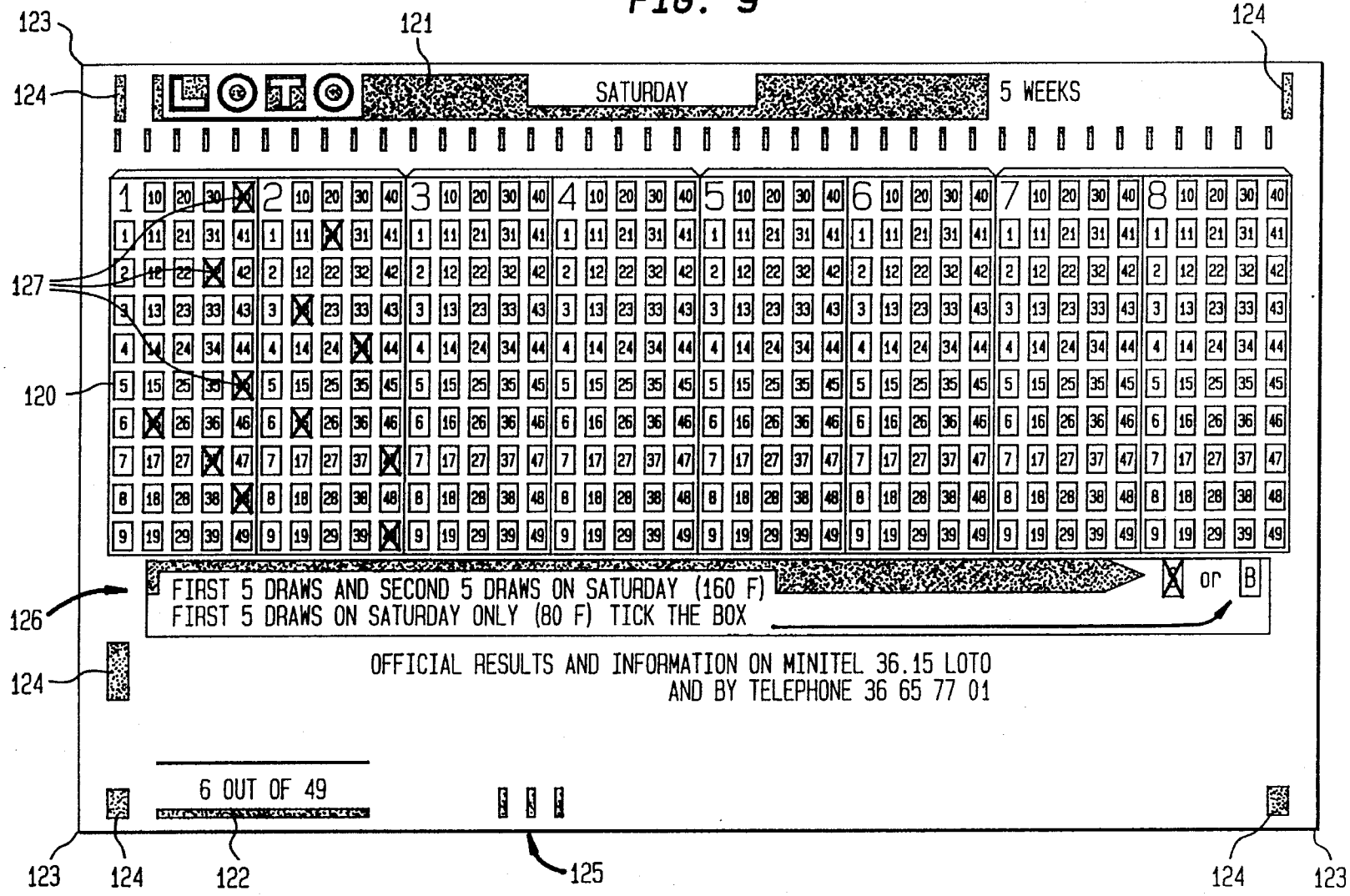
FIG. 9 shows a gaming coupon intended to be processed by the device.

Represented in FIG. 9 is a lotto gaming coupon which includes a gaming grid 120 containing numerals printed in the color of emission of the light sources of the detector, that is to say in red in the present example.

This coupon furthermore bears, printed in red, an upper zone 121 indicating the day and period of validity of the coupon and to the left of this zone, the word "LOTTO" is printed on a blue background in respect of the letters L and T and on a red background in respect of the letters O.

The ticket moreover includes a lower zone 122 with red background on which appears in white the inscription "6 out of 49" indicating the number of numerals to be ticked.

The other zones of the coupon are printed in colors which allow them to be detected by the reading device.

These are regions 123, 124 for aligning the coupon, a region 125 for identifying the type of game to which the coupon belongs and inscriptions 126 indicating for example the number of draws and the corresponding prize to be paid out.

Finally, marks in the form of crosses 127 have been made by a player on the coupon and constitute the latter's variable data.

Figure 10:
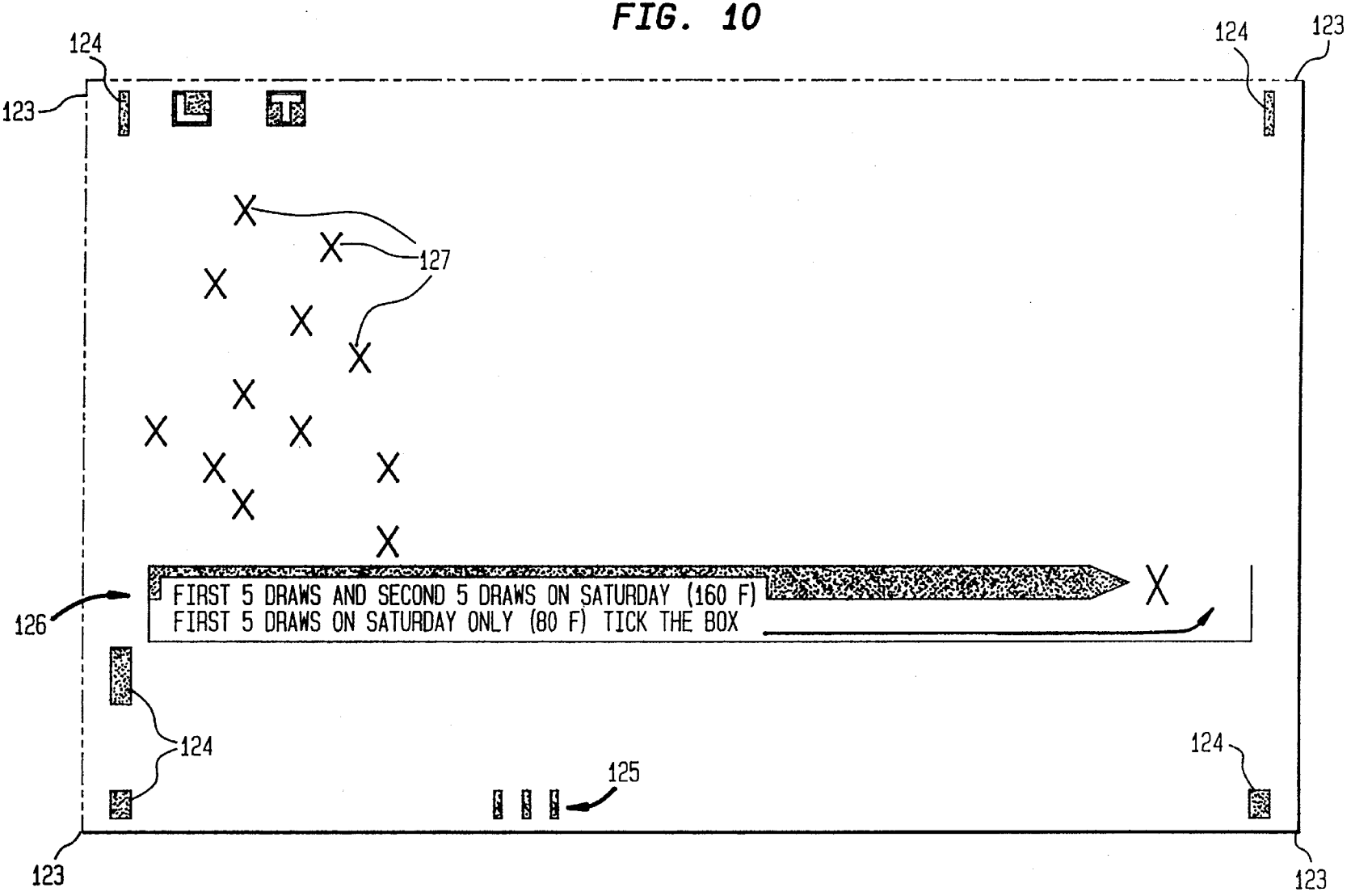
FIG. 10 shows the data of the gaming coupon of FIG. 9 which are picked out by the reading device.

Represented in FIG. 10 is the image of the coupon of FIG. 9 which results from the analysis by the device according to the invention and which appears on the display means associated with the latter.

It is seen that all the regions printed on the coupon in the color to which the device has been rendered blind, have disappeared from the image of the coupon and that there remain only the variable data consisting of the crosses 127 made by the player and the fixed data printed in colors other than red, such as the alignment tags 123, 124, and the code 125 designating the type of game, together with certain inscriptions such as 126.

As will be seen later, the image of the coupon of FIG. 10 will be completed by superimposing on the information of FIG. 10 from the image, a reconstructed game analysis marking pattern such as a grid identical to the grid 120 of the coupon of FIG. 9

Figure 11:
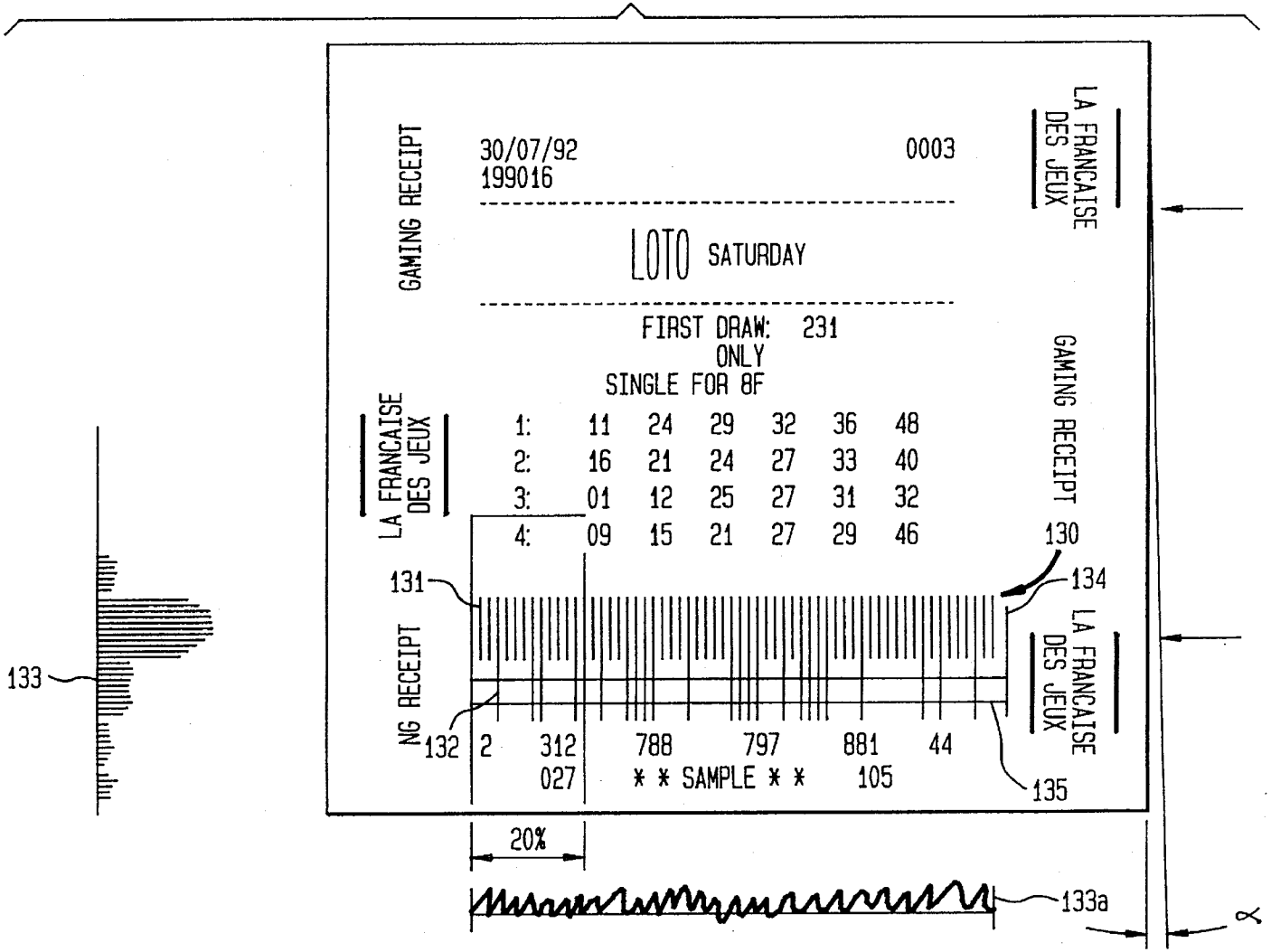
FIG. 11 shows a receipt issued by the terminal and analyzed by the device.

Represented in FIG. 11 is the image of a gaming receipt delivered to the player by the gaming terminal and the reading of which is also ensured by the analysis device according to the invention.

The receipt also includes a number of regions intended to be analyzed and in particular a region 130 containing a bar code for validating the coupon presented by a player.

This is a code which must be identified and compared with a corresponding code stored in the central unit.

This code, which is sometimes printed with printing defects, must be recognized by the device according to the invention with maximum accuracy.

It consists of a first part 131 formed of bars arranged at regular intervals and which embody clock signals and of a second part 132 formed of bars defining data signals corresponding to the validation code proper.

To the left of the receipt thus constituted is represented a histogram 133 of the bar code generated by the analysis device intended for calculating the separation between the clock signals and the data signals.

Under the lower edge of the receipt is represented a horizontal histogram 133*a* intended for calculating the angle of inclination $\alpha$ of the receipt.

Analysis of the receipt is ensured by sweeping two rectangular sectors 134, 135 defined in the parts 131 and 132 of the bar code.

The positions of the sectors 134 and 135 are chosen on each side of the line of separation of the clock signals and data signals.

Figure 12:
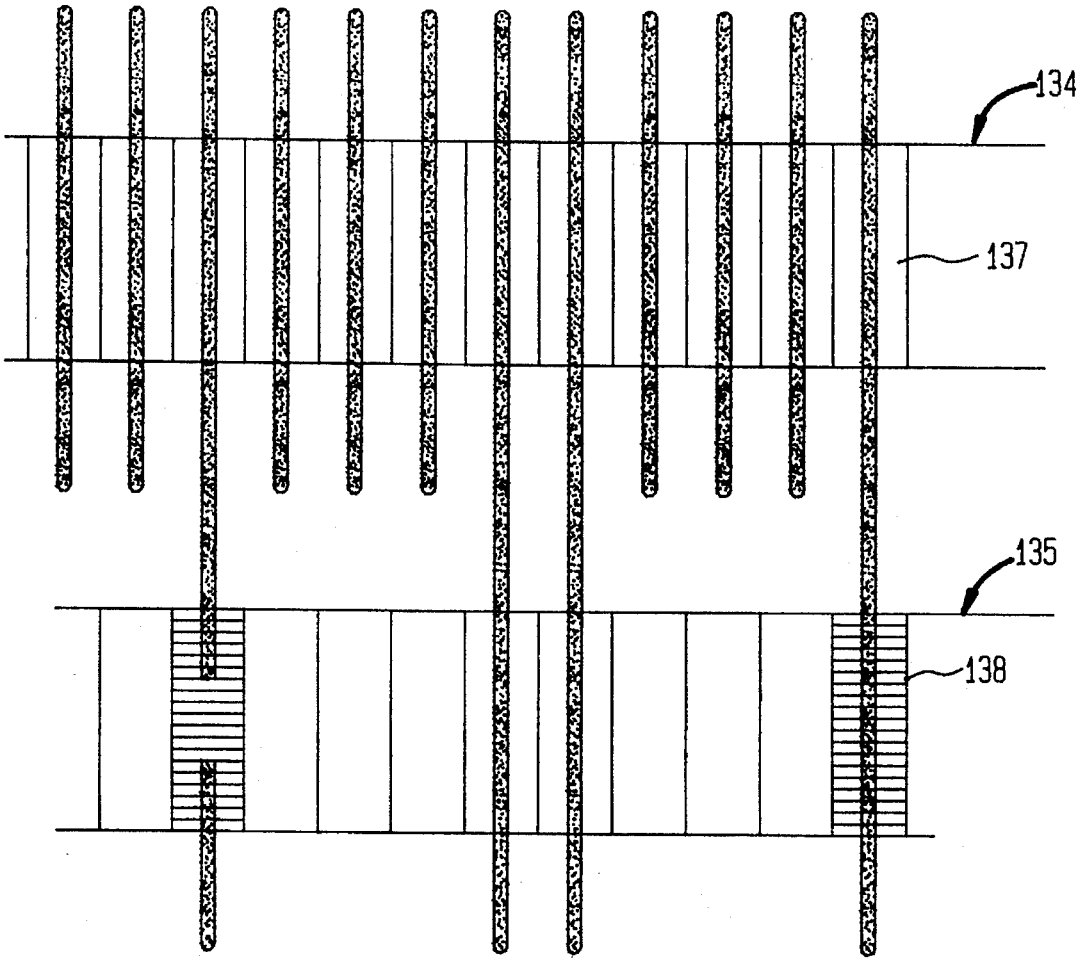
FIG. 12 is a view of the bar code of the receipt of FIG. 11 on a larger scale, showing the manner of analysized said code.

As represented in FIG. 12, in the sector 134 of part 131 of the bar code embodying the clock signals, there are defined adjacent windows 137 each surrounding a portion of bar.

Next, in sector 135 of part 132 of the bar code corresponding to the data signals, there are defined windows 138 each surrounding the possible location of a portion of bar and the presence or absence of a bar in each window 138 is determined through line-by-line sweeping.

This sweeping takes account of the printing defects, since it is accepted by convention that the detecting of for example 60% of the points out of the totality of points forming a bar confirms the presence of a bar and causes it to be taken into account in respect of the analysis of the code.

Next, the counting of the data signals is carried out by performing a logical AND operation between a clock bar and a data bar which may possibly lie opposite this clock bar.

The simultaneous presence of a clock bar and a data bar induces the issuing of a logic 1, while the presence of a clock bar and the absence of a data bar induces the issuing of a logic 0.

It is therefore seen that in this way the validation numeral borne by the receipt is reconstructed highly accurately.

The executing of an analysis operation with the aid of the device according to the invention will now be described with reference to the flowcharts of FIGS. 13 and 14.

The sweeping operation is triggered by the presenting of a document to the analysis device by insertion between the roller 102 and the image detector 101.

As represented in FIG. 8, the plane of symmetry of the roller 102 perpendicular to the transparent face 113 of the detector is offset with respect to the optical axis of the set of light conductors 114 so that the edge of a document engaged between the roller 102 and the light detector 101 may lie beyond this optical axis and so that the document may reflect the light originating from the light-emitting diodes 110 as soon as it is put in place.

The parallelism between the edge of the document and the lines of light-emitting diodes is checked by making provision for a minimum number of photosensitive elements 116 to have to receive the light reflected by the edge of the document in order to accept that its position with respect to the line of diodes is correct, that is to say that its defect in parallelism with respect to the line of diodes is tolerable.

This parallelism can also be checked by determining a minimum distance between two illuminated photosensitive elements. When this minimum distance or the minimum number of photosensitive elements is reached, the processing device actuates the stepper motor for driving the roller 102 and line-by-line reading of the document can be performed. The minimum distance between two elements or the minimum number of illuminated light-emitting elements differs depending on the transverse dimension of the document to be analysed.

The placing of a document on the analysis device is performed in phase 140.

Whether the document is a coupon or a receipt is determined by means of the detectors 117, 118 during phases 141 and 142.

Figure 14:
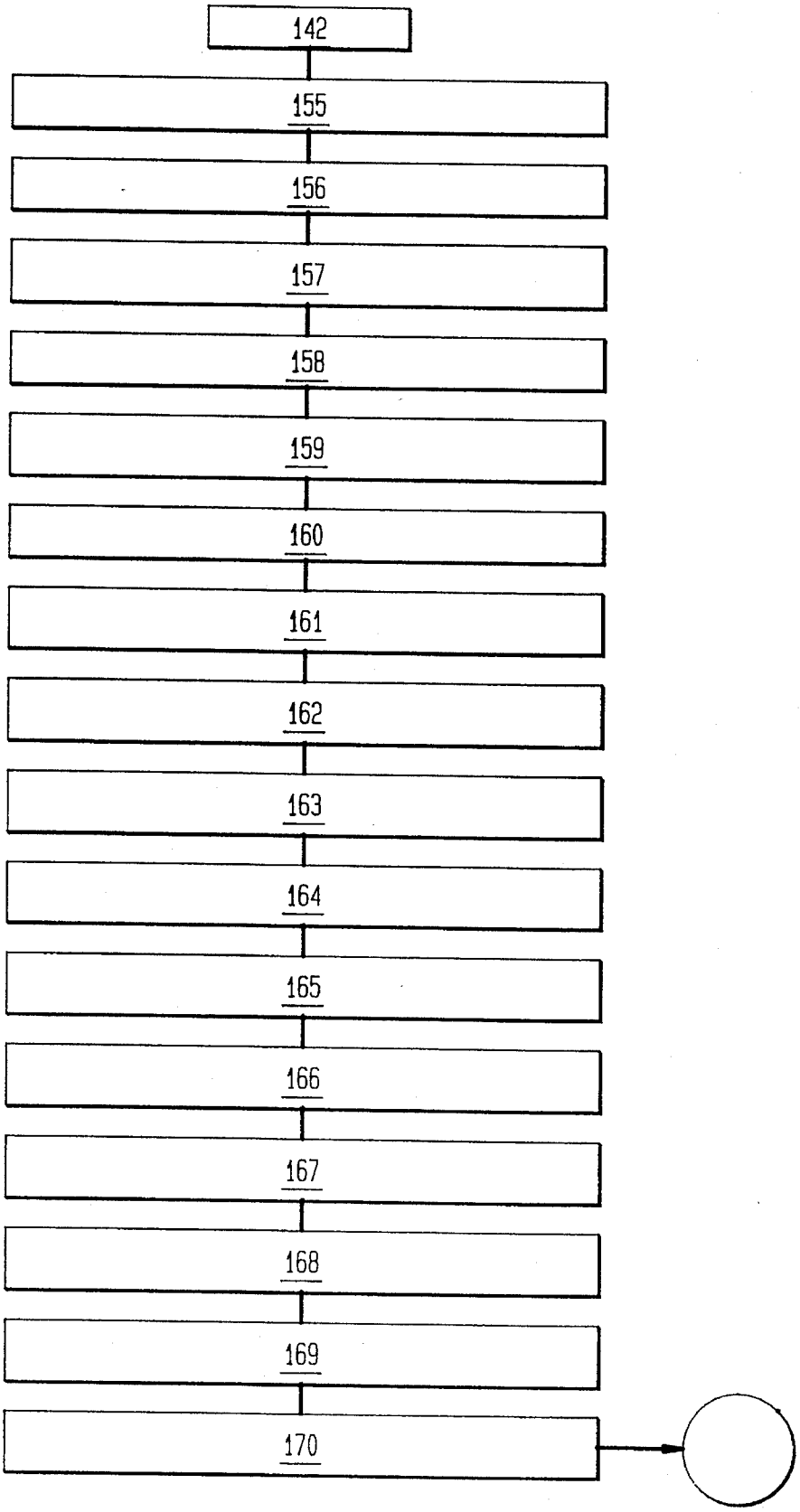
FIG. 14 is a flowchart illustrating the operation of the analyzisng device for a receipt.

If the document is a receipt, its processing will be examined with reference to FIG. 14.

If the document is a gaming coupon, during phase 143 the edges of the coupon which are embodied through eight tags 123 represented in FIGS. 9 and 10 are searched for with a view to the approximate aligning of the coupon.

After the aligning is carried out, a search is made for the marks 124 for accurate alignment of the coupon, which are represented in FIGS. 9 and 10 by blocks.

This search is effected in phase 144. If the coupon does not include any marks for accurate alignment, it is established during phase 145 that the coupon examined is a coupon of the old type which requires, during a procedure embodied overall by a phase 146, a specific search corresponding to each coupon.

If the coupon includes marks 124, it is established during phase 147 that this is a coupon which can be processed by the device.

During phase 148 the inclination of the coupon with respect to the generatrix of the roller 102 is established and the processing system compensates for this inclination.

During the subsequent phase 149 the coupon is searched for the code relating to the type of game to which it belongs and which is represented at 125 in FIGS. 9 and 10.

During phase 150 there is undertaken the sending of the code relating to the type of game to a device with memory for storing the various information items relating to the gaming grids, which during phase 151 sends back a table of regions.

During phase 152 there is undertaken the search for the crosses in the regions of the ticket where they have been placed.

During phase 153 the information relating to the table and to the crosses placed by the player on the ticket and embodied by their coordinates is returned to the central unit. The recording of the data relating to a coupon is then complete.

The processing of a receipt will now be described with reference to the flowchart of FIG. 14.

Figure 13:
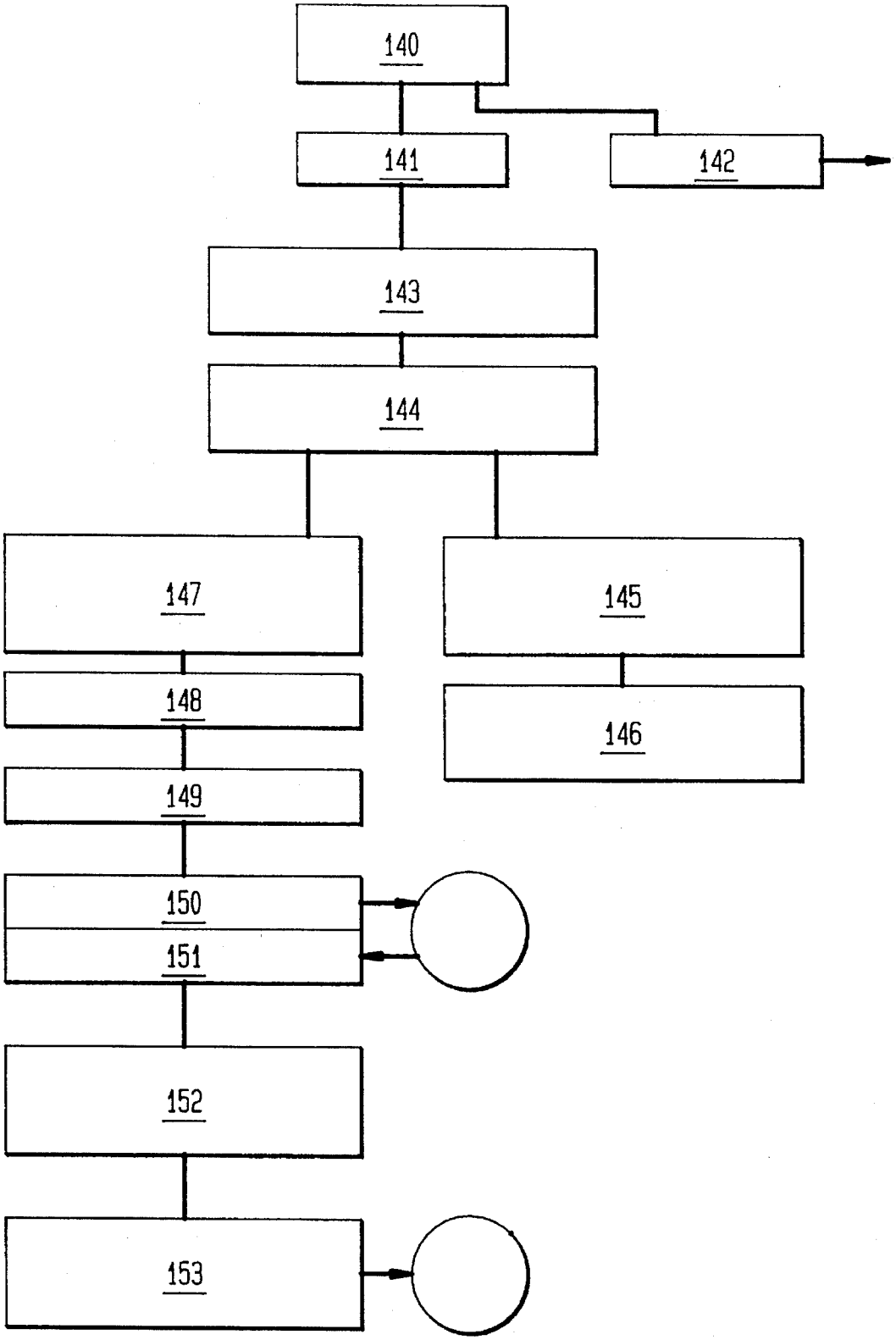
FIG. 13 is a flowchart illustrating the operation of the analysis device for a gaming coupon.

After having established during phase 142 mentioned at the time of describing FIG. 13 that the document inserted into the analysis device is a receipt, the straight edges of this receipt are searched for during phase 155.

Then, during phase 156, the inclination of the receipt is calculated and, during phase 157, the region 130 containing the bar code which is represented in FIG. 11 is searched for.

During phase 158, the compensating of the inclination calculated during phase 156 is undertaken.

During phase 159, a horizontal histogram is compiled of a region of about 20% of the region 130 containing the bar code followed by a filtering and digital smoothing which are performed during phase 160.

During phase 161 a search is made for the downward verge in the largest area of the graph of the histogram 133 (FIG. 11).

During phase 162 the largest downward verge corresponding to the center of the bar code is pinpointed.

During phase 163 the adjacent regions 131, 132 (FIG. 11) representing the clock and data signals respectively are determined.

During phase 164 the histogram relating to the codes in the region of the clock signals 131 is compiled.

During phase 165 the smoothing and extraction of the clock bits is undertaken as is a rescaling by compiling an average.

Whether the number of clock signals is correct is determined during phase 166. If the answer is no, the receipt is regarded as being illegible and is rejected. If the answer is yes, we go to phase 167 in which, on the basis of the clock signals, the regions for sampling the data or windows 137 are determined by shifting the phase of the clock signals by half a period.

During phase 168 the data in each region or window 138 corresponding to the window 137 are searched for by undertaking a discrimination by threshold and by regarding as valid the data represented by a specified fraction of the total number of points, two thirds for example.

During phase 169 the four bits by four bits reformatting of the clock signals is undertaken, of which there are 60 for example, that is to say fifteen times four bits.

During phase 170 the corresponding binary value is calculated, and is transmitted to the central unit.

Examination of the validation numeral of the receipt is thus complete.

The operation of the entire device according to the invention will now be specified with reference to FIGS. 7 and 8.

When the detectors 117, 118 detect the presence of a document at the input of the device, the information is transmitted through circuit 119 to the processing unit 105 which monitors the analyzing device and the stepper motor 104. The processing unit then activates the light-emitting diodes 110, (FIG. 8) of the analysis device and the latter begins to scan a line.

When the document is parallel to the light source in the layout indicated earlier, the central unit 105 controls the stepper motor 104 in such a way that a line is analysed after each advance by one step.

Next, the central unit 105 uses the signals delivered by the input detection system of the analyzing device consisting of the detector 117 and 118 and the circuit 119 for determining whether part of the document is still to be analyzed.

Once the detection system no longer sees any document at the input, it transmits the absence of document information to the central unit 105 which calculates the difference in position between the line currently being analyzed by the analyzing device, and the back edge of the document in order to establish the number of steps which the motor 104 must make so that the analysis of the document may be finished to the end.

The image is analyzed line by line with for example a resolution of 40 steps per cm and each line possesses a resolution of 80 steps per cm.

The vertical resolution can be modified by modifying the transmission ratio between the output shaft of the stepper motor 104 and the document drive roller 102.

The vertical resolution depends on the construction of the image detector 101.

During the operations for sweeping a document, the data analyzed line by line by the device, are transmitted by the processing unit to the data storage memory 106 with a view to their subsequent transmission to the central unit with which the device according to the invention is associated.

In the example just described, the light source of the image reader is formed of a series of diodes having elements of red color with a wavelength of 650 to 670 nanometers.

It is also conceivable to associate elements for filtering a first color with a first series of light-emitting diodes and to associate elements for filtering at least one other color with at least one other series of light-emitting diodes, and thus to render the reader blind to two or more colors.

It is also conceivable to substitute the light-emitting diodes with a discharge tube emitting monochromatic light directly or else associated with an appropriate filtering element.

Figure 15:
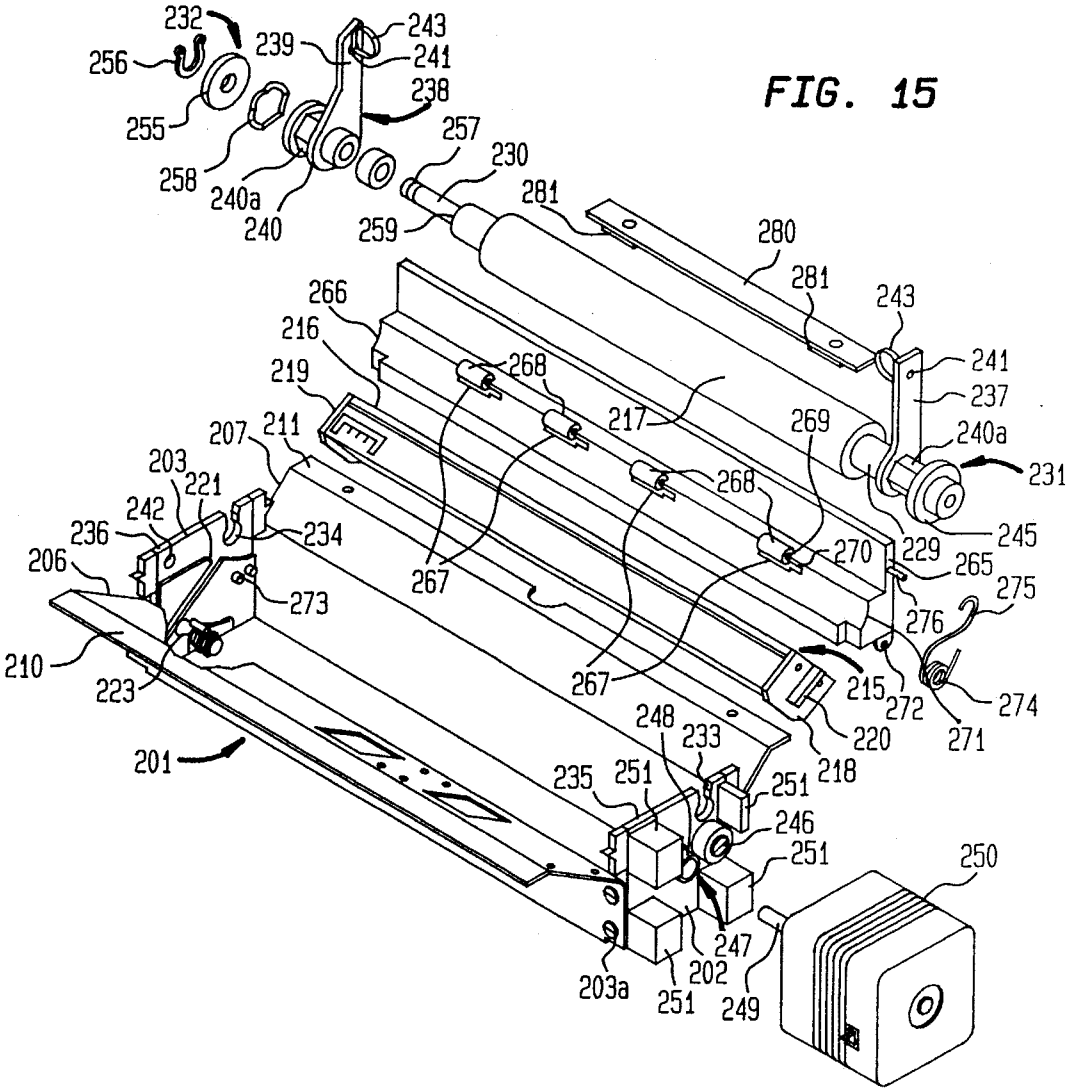
FIG. 15 is an exploded perspective view of the device for analyzing information carriers.

The device for analyzing information carriers or documents, represented in FIG. 15, includes a housing 201 in the form of a channel of general U section with splayed-out edges, made from sheet metal and closed at its ends by flanges 202 and 203, made from plastic for example, fixed to the housing 201 for example by screws 203*a*.

Figure 17:
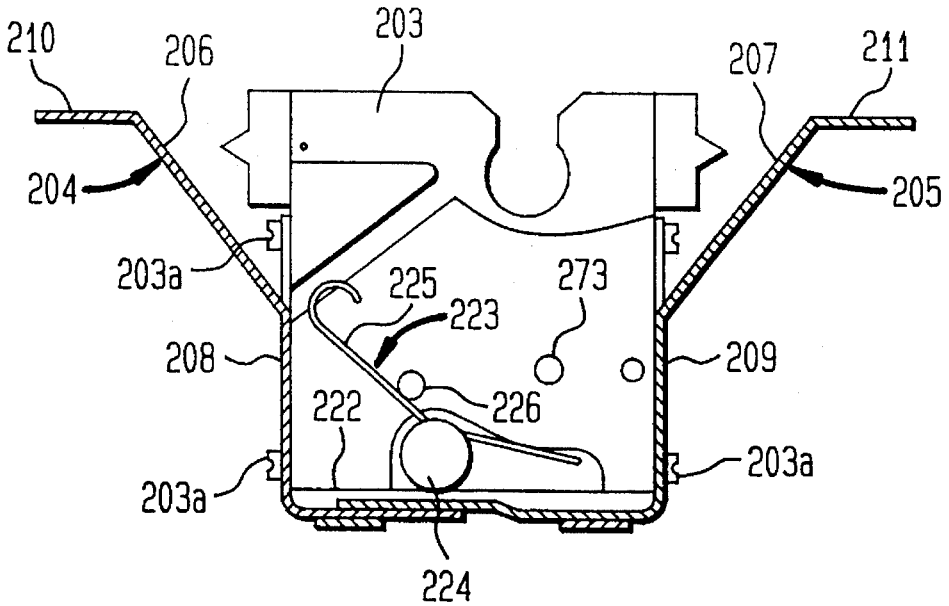
FIG. 17 is a view in transverse section of the housing of the analisis device, some of the parts of which have been removed.

The splayed-out edges 204 and 205 of the housing 201 include, as is seen clearly in FIG. 17, sloping portions 206, 207 each prolonging a vertical wing 208, 209 of the housing and horizontal rims 210, 211.

This splayed-out shape of the housing 201 facilitates the mounting of the device in a larger assembly such as for example a gaming terminal or the like.

In the housing thus constituted, is arranged an image detector 215 of elongate parallelipipedal shape extending throughout the length of the housing and consisting of a linear light source (not depicted), means for focusing the light emitted by the source onto a transparent wall 216 situated opposite a roller 217 for driving documents and photo-sensitive elements (not depicted) for detecting the light beams originating from the linear source when they are reflected by a document placed between the transparent wall 216 and the roller 217.

At its ends the image detector 215 includes mounting plates 218, 219 which, as seen on plate 218, each include a projection 220 co-operating with a sloping groove made in each of the end flanges 202, 203 of the housing, only the groove 221 of the flange 203 being visible, to enable the image detector 215 to be mounted in the housing 201.

As is clearly seen in FIG. 17, in the lower part of each end flange 202, 203 of the housing, in proximity to the bottom 222, is fixed a hairpin spring 223 mounted on a stud 224 solid with the corresponding flange 203 and including a curved-back branch 225 held in abutment against a pin 226 and intended to come into contact with an edge of the corresponding plate 219 for mounting the image detector 215 in order thus to provide for suspension or floating mounting of the detector 215 in the housing 201.

The image detector 215 is held in place in the housing by the drive roller 217 whose periphery is covered, as known per se, with a layer of cellular rubber 228 or the like.

At each of its ends the roller 217 includes spindles 229, 230 provided with corresponding bearings 231, 232 intended to be received in respective notches 233, 234 made in the upper edges 235, 236 of the end flanges 202 and 203 of the housing 201.

The bearings 231, 232 are each provided with a catch 237, 238 for immobilizing the roller 217 with respect to the housing 201.

These catches are identical, so that only the one which is more visible in the drawing, namely the catch 238, will be described.

It includes a stem 239 solid with a hub 240 forming one of the parts of the corresponding bearing and provided with fans 240a for engaging the bearings in the corresponding notches 233, 234 of the flanges 202, 203 when the catches are in the released position.

At the end of the stem 239 away from the hub is provided a hole 241 which co-operates with a locking lug 242 provided on the corresponding end flange of the housing 201.

Interlock is ensured, after placing the ends of the roller 217 into the corresponding notches 233, 234 of the housing 201, by rotating the catches 237, 238 and engaging the locking lugs such as lug 242 in the corresponding holes such as the hole 241 in the catches.

The elasticity of the catches 237, 238 permits slight deformation of the latter towards the inside of the housing in order to enable them to be engaged on the locking lugs 242.

A tab 243 provided at the end of each catch makes it possible to facilitate its unlocking manoeuvre with a view to the disengaging of the roller 217.

Figure 18:
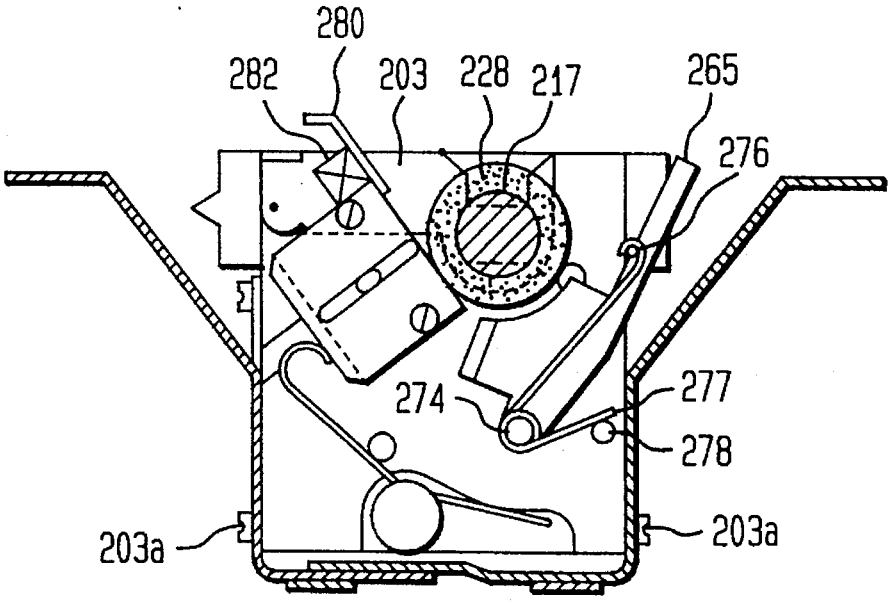
FIG. 18 is a view in transverse section of the assembled device.

As represented in FIG. 18, when the roller 217 is in place in the housing 201, it bears against the transparent face 216 of the image detector 215 and causes the tensioning of the springs for suspending the image detector which thus apply the detector 215 permanently against the roller 217 as a result of the sliding mounting of the detector 215 in the sloping guide grooves 221 of the housing.

Permanent contact is thus obtained between the detector and the roller, whether a document to be analyzed is present interposed between these two elements or not.

The end spindle 229 of the roller 217 bears a pinion 245 for rotational driving of the roller which enmeshes with the output pinion 246 of a reduction gear 247 with two pinions 246 and 248 mounted rotatably on spindles fixed to the flanges 202 of the housing 201. The input pinion 248 of the reduction gear is jammed onto the output shaft 249 of an electric stepper motor 250 for driving the roller fixed to the flanges 202 by way of ties 251 made from the same material and which leave between themselves a space sufficient to accommodate the pinions of the reduction gear 247.

The bearing 232 mounted at the end of the roller 217 away from the drive pinion 245 includes, interposed between the part 240 forming a hub for the catch 238 and a washer 255 bearing on a circlipse 256 engaged in an end groove 257 of the spindle 230 of the roller 217, a crinkle washer 258 whose elasticity ensures tight mounting of the bearing 232 against a corresponding shoulder 259 of the spindle 230 of the roller, the bearing 232 thus forming a brake intended to damp the vibrations which are due to the stepped driving of the roller 217 and which are transmitted to the roller 217 by the latter's drive pinion 245.

Figure 16:
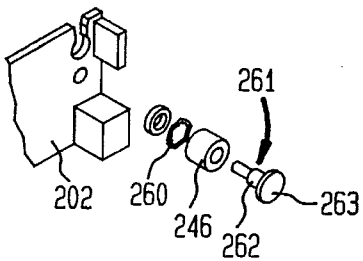
FIG. 16 is an exploded perspective view of a detail of the device of FIG. 15.

Analogously, as represented in FIG. 16, the output pinion 246 of the reduction gear 247 is likewise mounted on its spindle by way of a crinkle washer 260, the spindle of the pinion 246 consisting of a threaded rod 261 including a smooth portion 262 for receiving the pinion 246 and a head 263 for axial retention of this pinion.

When the threaded rod 261 is screwed into a corresponding tapped hole made in the flange 202 of the housing 201, the crinkle washer 260 is compressed and provides for the rotational braking of the pinion 246 and thus the damping of the vibrations transmitted to it by the stepper motor 250.

An oscillating flap 265 for receiving the documents after they are read by the device is furthermore arranged inside the housing. The oscillating flap 265 has an almost square-shaped outline and also extends throughout the length of the housing between the latter's flanges 202 and 203. It includes a longitudinal thickening 266 in which are made pockets 267 for receiving idlers 268 mounted rotatably on spindles 269 engaged removably by snap-fitting into slots 270 provided on either side of the pockets 267. There are four idlers 268 and they are distributed uniformly over the length of the oscillating flap 265.

The longitudinal thickening 266 of the oscillating flap 265 has a concave face 271 shaped as a portion of a cylinder coaxial with the roller 217 in order to promote passage of the documents.

The flap 265 is mounted oscillating on the end flanges 202 and 203 of the housing 201, by way of forks 272 which each co-operate with a spindle 273 which is perceived on the flange 203 turned towards the inside of the housing 201. The flap 265 is held in position by hairpin springs 274, one branch 275 of which is curved back and hooked onto a stud 276 provided on the end edge of the flap and the opposite end 277 of which is straight and abuts against a pin such as 278 arranged beside the spindle 273 on the flange 203 of the housing 201.

Thus, the springs 274 ensure the permanent application of the idlers 268 against the roller 217.

The role of the idlers 268 is, on the one hand, to escort the documents driven by the roller 217 up to the rear edge of the document and, on the other hand, when a document is freed by the roller 217, to bring it back against the flap in co-operation with an abutment which will be described with reference to FIG. 19.

Of course, the corresponding elements are provided on the flange 202 to provide for the oscillating mounting of the flap 265 at its two ends.

As can be seen in FIG. 18, the device is completed with a guide 280 fixed by ties 281 (FIG. 15) inside the housing 201 and which is intended to facilitate the insertion of the documents between the roller 217 and the image detector 215.

Sensors 282, for example infrared sensors, are furthermore arranged along the guide 280 in order to detect the presence of a document at the entrance of the device.

Advantageously, there are two of these sensors and their distancing is designed in such a way as to allow determination of the kind of document presented to the device according to the width of this document.

Such a layout is described in the aforesaid French Patent Application No. 92 10 642 filed on 7 Sep. 1992 by the Applicant and entitled "Device for analyzing information carriers, especially gaming coupons".

Instead of being mounted oscillating, the flap for guiding and receiving the information carriers can be mounted fixedly in the housing of the device and the idlers which it bears can be applied against the roller 217 by elastic members.

Figure 19:
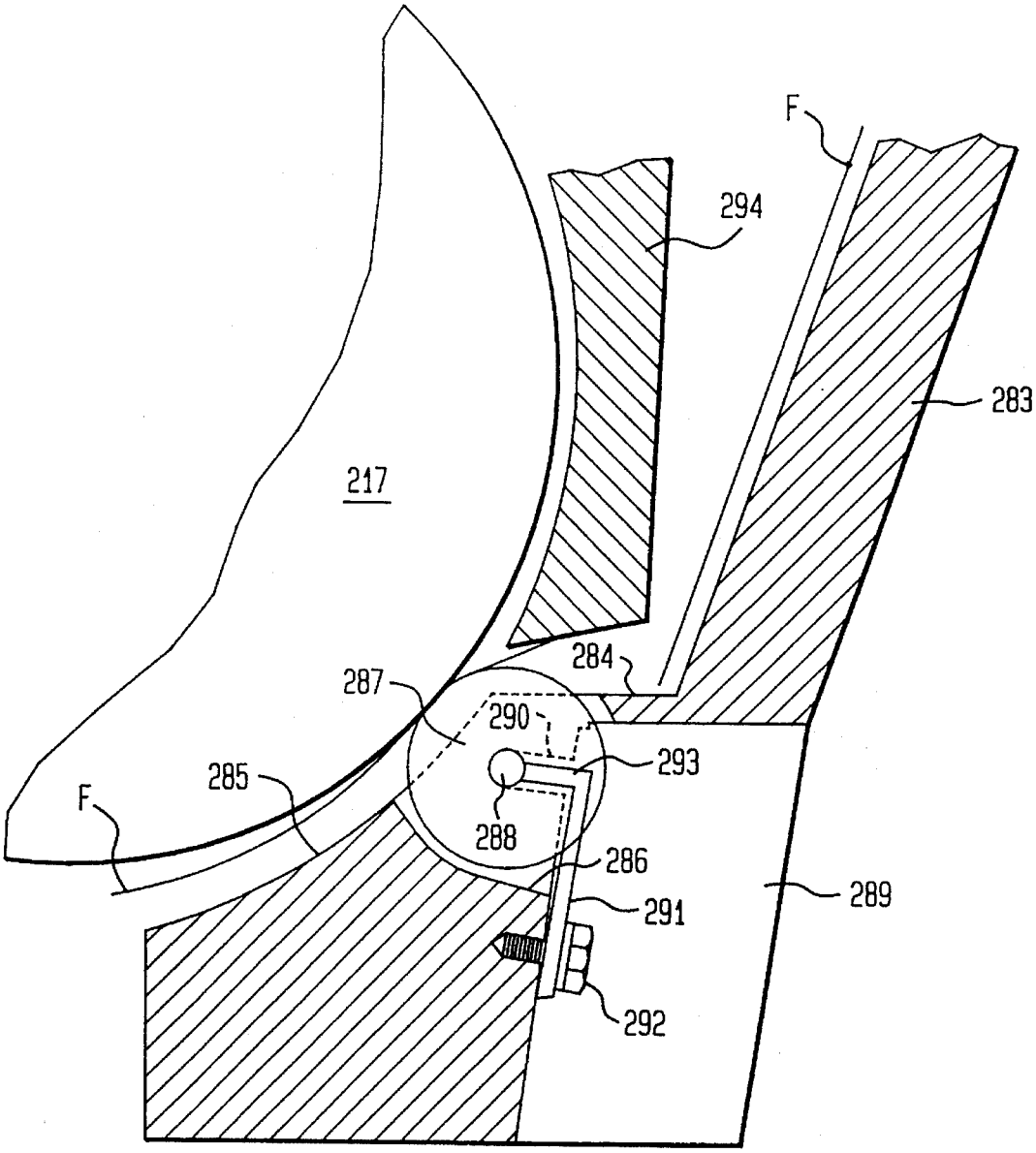
FIG. 19 is a sectional view on a larger scale of a variant of the flap for guiding and receiving documents.

Such a variant is represented in FIG. 19.

According to this variant, the guide flap 283 fixed inside the housing (not depicted) of the device includes, like the oscillating flap 265 of FIG. 15, a thickening 284 having a concave face 285 in the shape of a portion of a cylinder and, in this thickening, pockets 286 for idlers 287 which have the same role as the idlers 268.

The idlers 287 are each mounted on a spindle 288.

In the face of the flap 283 away from the thickening 284 are made recesses 289 provided at the locations of the idlers 287 and emerging into the corresponding pockets 286.

A spindle 288 of an idler 287 is engaged into gullets 290 hollowed out in the bottom wall of each recess 289 on either side of the pocket 286 and is applied to the bottom of the said gullets by a leaf spring 291 fixed in the bottom of the recess by a screw 292 and having a branch 293 bent at right angles and having the shape of a fork, in contact with the ends of the idler 286 projecting with respect to the latter.

Thus, each idler 286 is pulled by its spring 291 into the out position with respect to the inward-curving face 285 and consequently against the roller 217.

Lastly, in FIG. 19, is represented an abutment 294 which can also be provided in the embodiment of FIG. 15 and which serves in co-operation with the idlers 287 to allow the stacking of the sheets F of processed documents as they exit the device.

For this purpose, the abutment 294 includes a sloping edge against which the front edges of the sheets F abut so as then to be pushed against the stack of sheets F already built up against the flap.

The document analysis device just described also includes means for processing the information read by the image detector and means for controlling the electric stepper motor 250 to allow the sweeping of the document by successive line-after-line scans.

These means, which do not actually form part of the present invention, are also described in the aforesaid patent application.

In the present embodiment, the device according to the invention being applied essentially to the analysis of gaming coupons and receipts, the image detector consists of an optical reader which is blind to at least one color in which the fixed information is printed on the document to be examined and which is sensitive to other colors so as to take into account only the variable gaming information and the fixed information for aligning the document and for designating the type of game to which it belongs, which information is printed in these other colors.

This image detector is also described in French Patent Application No. 92 10 642 cited above.

It will however be understood that the information carrier analysis device according to the invention can include an image detector of different construction on condition however that it is of linear type and allows the documents submitted to it to be scanned while filing past.

It would for example be conceivable to substitute the image detector described above with a global-reading scanner for box-by-box scanning of a document and for positive recognition of the signs borne by the document, such as those used for example by fax machines.

The device 11 for reading magnetic codes and optical codes will be described with reference to FIGS. 20 to 22.

Figure 20:
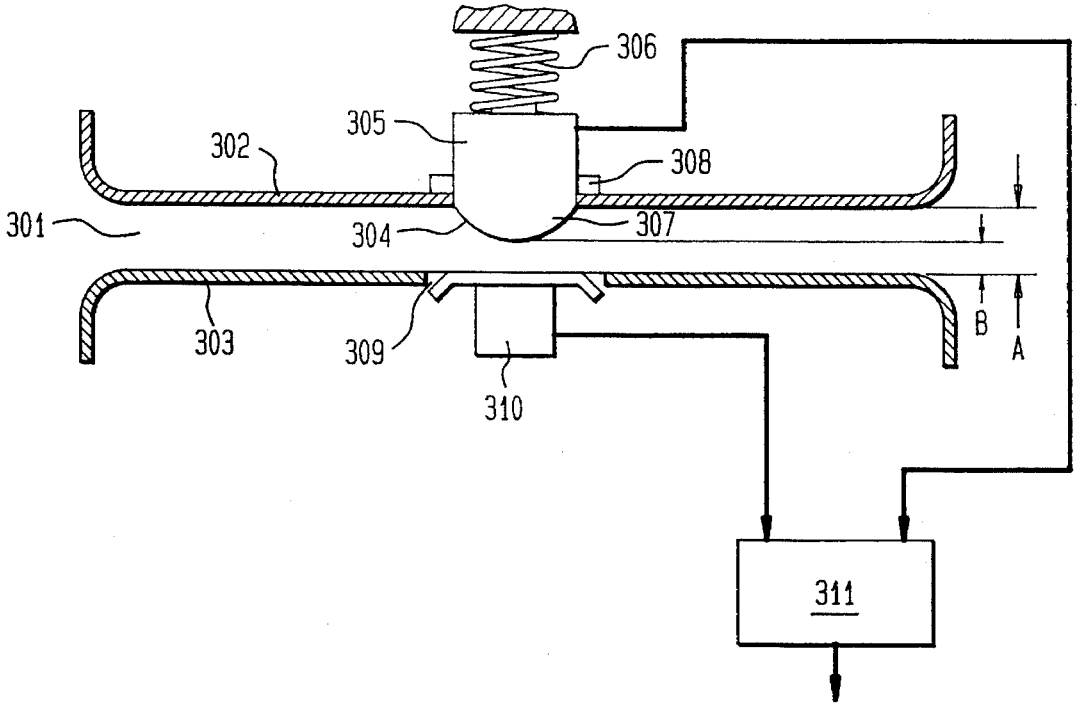
FIG. 20 is a sectional diagrammatic view of a first embodiment of a magneto-optical reader forming part of the terminal according to the invention.

Represented diagrammatically in section in FIG. 20 is a slot 301 for receiving magnetic code carriers generally produced in the form of cards of thickness A and optical code carriers of smaller thickness sometimes consisting of sheets of paper or the like on which the bar codes are printed.

The slot 301 is delimited by two opposite walls 302 and 303.

In the wall 302 is made an orifice 304 in which is mounted a magnetic reading head 305 pulled towards the inside of the slot by a spring 306 and having an end 307 opposite the spring, of rounded shape allowing clearance of the head on insertion of a card of thickness A (not shown) and application of the latter under the effect of the spring 306 against the magnetic tracks borne by the card.

Engagement of the magnetic head 305 into the slot 301 is limited to a value smaller than the width A of the slot by an abutment 308 co-operating with the wall 302 of the slot.

In the wall 303, of the slot 301 opposite the wall 302, is made another orifice 309 in which is arranged fixedly an optical reading head 310, so as to be flush with the inside edge of the wall 303.

Thus, between the rounded end 307 of the magnetic head and the wall 303 of the slot opposite the wall 302, is made a gap of width B which allows, when the magnetic head is not used, the free passage into the slot of an optical code carrier of small thickness and the reading of the bar codes which it bears by the optical reading head 310.

According to another embodiment, the magnetic head 305 can be mounted on the wall by means of a leaf spring which simultaneously provides for the function of applying the reading head 305 against the magnetic tracks of the card and limiting the engagement of the magnetic head into the slot 301 in the absence of a magnetic card in order to define between the magnetic reading head and the optical reading head 310, flush with the inside edge of the wall 303, a gap of width B for the insertion of an optical code carrier.

The magnetic head 305 and the optical reading head 310 are both linked to a circuit 311 such as a microprocessor forming part of an installation equipped with the magneto-optical head according to the invention and intended to recognize the output signals from one or the other of these heads with a view to allowing appropriate subsequent processing of the signals.

Figure 21:
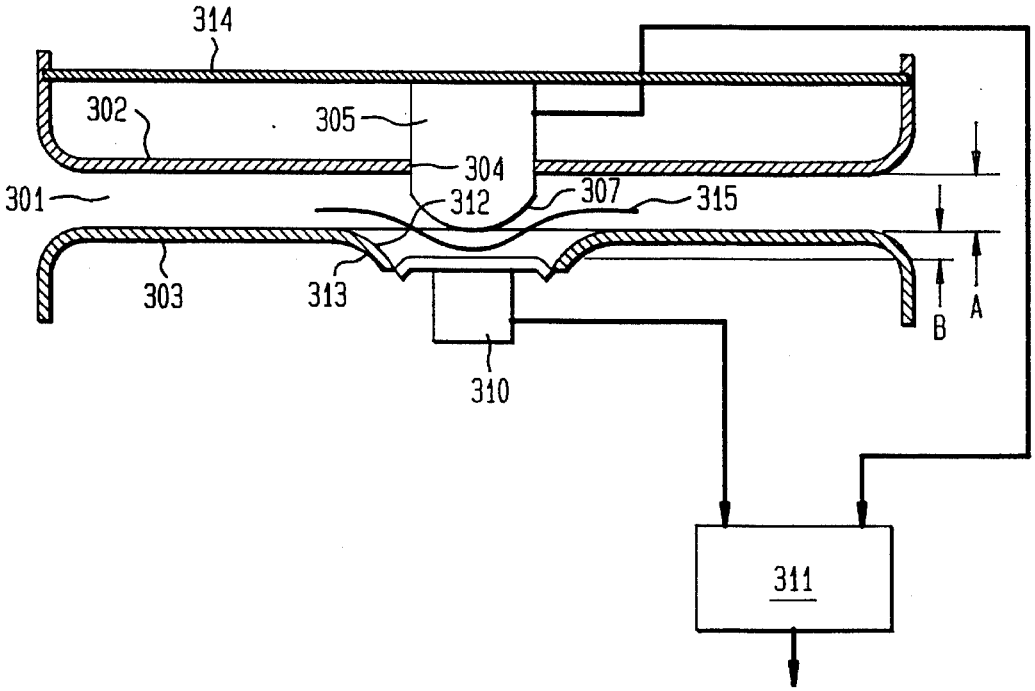
FIG. 21 is a sectional view similar to that of FIG. 20 representing a variant of the magneto-optical reader.

In FIG. 21 is represented a variant of the magneto-optical reader according to the invention.

In this variant, the elements of which corresponding to those of FIG. 20 bear the same reference numerals, the slot 301 is likewise delimited by walls 302 and 303.

In the wall 302 is made an orifice 304 granting passage to a magnetic reading head 305.

In the wall 303 of the slot opposite the wall 302 is on the other hand made an orifice 312 which differs from the orifice 309 made in the wall 303 of the embodiment of FIG. 20, in that it includes rounded edges 313 to allow the positioning of an optical reading head 310 set back slightly with respect to the inside edge of the wall 303.

The magnetic head 305 is linked to the wall 302 of the slot 301 by an elastic leaf 314 which provides for the retracting of the magnetic head 305 on the insertion of a card into the slot 301 and the application of the head against the magnetic tracks of the card.

On the other hand, in the absence of a magnetic card, the elastic leaf 314 returns the magnetic head 305 to a rest position in which its rounded end 307 comes level with the inside edge of the wall 303 of the slot in which the optical reading head 310 is arranged. However, since the optical reading head is mounted set back slightly with respect to the inside edge of the wall 303, a gap of width B is made between the magnetic head 305 and the optical reading head 310 for the passage of an optical code carrier consisting, for example, of a flexible sheet 315.

In fact, the relative position of the magnetic and optical heads 305 and 310 delimits, in this embodiment, a chicane for the passage of the flexible optical code carrier.

Finally, the variant of FIG. 21 also includes a circuit 311 for recognizing the output signals from the magnetic and optical reading heads.

Figure 22:
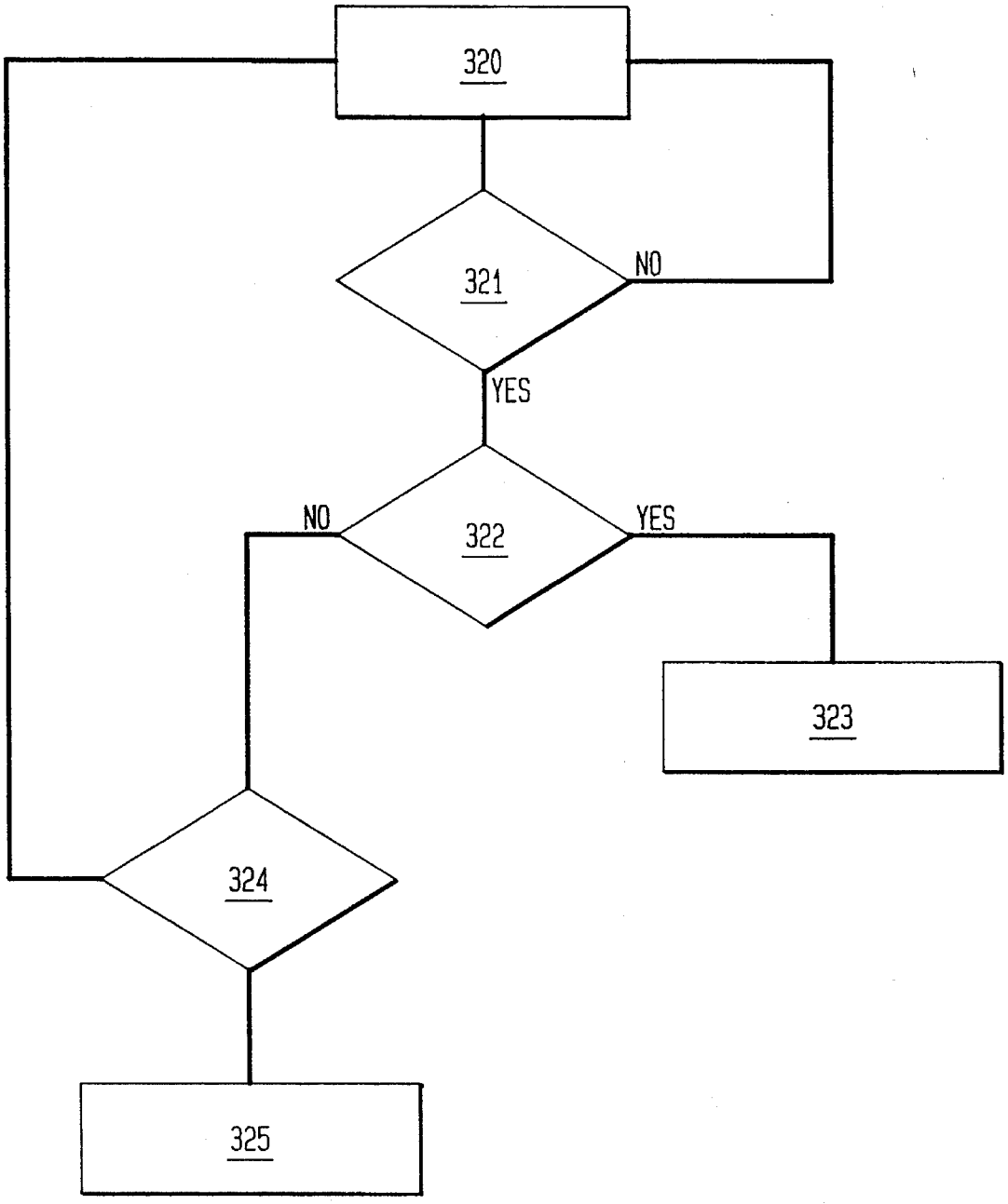
FIG. 22 is a flowchart of a way of determining the kind of signals delivered by the magneto-optical reader.

The flowchart of FIG. 22 illustrates a way of recognizing the kind of signals emitted by the magneto-optical reading device according to the invention.

Reading is firstly undertaken with the aid of the optical reader 310, during a phase 320. The next phase 321 consists in determining whether any code carrier is present or not in the slot 301. In the event that this carrier is absent, return to phase 320.

If a carrier is detected in the slot, during phase 322 it is determined whether this is a magnetic card.

If the answer is yes, a processing of the magnetic signals is triggered during phase 323.

If the answer is no, it is determined during phase 324 whether the carrier present in the slot 310 is an optical code carrier.

If the answer is no, return to phase 320.

If the answer is yes, the processing of the optical signals is undertaken during phase 325.

Of course, the designating of the kind of signals emitted by the magneto-optical reading device and the processing of these signals are carried out in the circuit 311 associated with the said head.

A device for reading magnetic codes and optical codes, of the type described above, and forming the subject of French Patent Application No. 92 10 709 filed on 8 Sep. 1992 by the Applicant, may have the most diverse applications which are not, of course, limited to gaming terminals.

What is claimed is:

1. A gaming terminal for use with gaming coupons and receipts, comprising:

means for analyzing information carriers, including a single information carrier analysis device, having means for analyzing signs written by players on the coupons and for reading bar codes representing validation numerals of the receipts, and means for processing the information resulting from the analysis of the information carriers, for converting the information into digital data and for transmitting the information to a remote processing system through a communication network;

means for receiving validation data for the coupons and receipts from the remote processing system;

nonvolatile storage means for storing terminal instruction data transmitted from the remote processing system, and for storing gaming data received by the terminal;

data display means for displaying gaming information and instructions to the player and a retailer;

integrated-circuit passkey means for controlling an on-off circuit of the terminal and for permitting and prohibiting access to the terminal, wherein said passkey means defensively disables the terminal in response to an attempted access with an improperly coded passkey, until the retailer with a properly coded passkey reactivates the terminal; and terminal processing means operably connected to a keyboard assembly, the means for analyzing information carriers, the means for receiving validation data, the nonvolatile storage means, the data display means, and the integrated-circuit passkey means for controlling the terminal.

2. The gaming terminal of claim 1, wherein the means for analyzing information carriers further comprises:

means for inserting the information carrier;

means for determining the size of the information carrier;

means for reading the information on the information carrier, having an optical reader which is blind to at least one color in which fixed information is printed on the coupon and which the reader is sensitive to other colors for taking into account only variable gaming information and the fixed information for aligning the information carrier and for designating the type of game to which it belongs, which information is printed in these other colors; and wherein the processing means further comprises, means for generating marking patterns, for analyzing gaming coupons, corresponding to the type of game to which the coupon belongs for reconstructing the coupon's regions to be analyzed by superimposing on variable data and on fixed alignment and game type data, fixed marking pattern data to which the image reader has been rendered blind.

3. The gaming terminal of claim 1, further comprising a device for reading magnetic codes and optical codes, operably connected with the information carrier analyzing device.

4. The gaming terminal of claim 3, wherein:

the magnetic codes are carried by cards of specific thickness and the optical codes are by carriers of relatively less thickness, and the device for reading magnetic codes and optical codes includes a magnetic reading head and an elastic means for applying the magnetic head against a magnetic track of the card, the magnetic head is mounted one of two opposing walls which form a common slot with a width slightly greater than the thickness of the card, and an optical reading head and means for limiting the engagement of the magnetic reading head, in the absence of a magnetic card, leaving a gap sufficient for the passage of the carrier between the magnetic head and the wall of the slot opposite the magnetic head, and means for recognizing the output signals from the magnetic reading head or from the optical reading head.

5. The gaming terminal of claim 1, further comprising an integrated-circuit card reader operably connected with the information carrier analyzing device.

6. The gaming terminal of claim 1, further comprising means for monitoring a power supply to the terminal and for connecting the power supply to a supply circuit of the terminal, only when an integrated-circuit passkey has been inserted to the terminal and has a proper access code for the terminal.

7. The gaming terminal of claim 1, wherein the means for analyzing information carriers further comprises:

means for inserting the information carrier;

means for determining the size of the information carrier;

means for reading the information on the information carrier, having an optical reader which is blind to at least one color in which fixed information is printed on the coupon and which reader is sensitive to other colors for taking into account only variable gaming information and the fixed information for aligning the information carrier and for designating the type of game to which it belongs, which information is printed in these colors;

wherein the processing means further comprises, means for generating marking patterns, for analyzing gaming coupons, corresponding to the type of game to which the coupon belongs for reconstructing the coupon's regions to be analyzed by superimposing on the variable data and on fixed alignment and game type data, fixed marking pattern data to which the image reader has been rendered blind;

wherein the nonvolatile storage means comprises a segmented EEPROM memory of the "Flash" type, and the nonvolatile storage means further comprises a plug-in segmented EEPROM memory operably coupled with the "Flash" type memory, for storing the terminal instruction data and the gaming data received by the terminal and for enabling the data to be transported to the remote processing system;

a device for reading magnetic codes and optical codes, operably connected with the information carrier analyzing device; and electronic means for controlling the terminal comprising a microprocessor having a central processing unit, memories and circuits for interfacing with peripheral devices, a bus furthermore providing for the linking of the microprocessor with a modem for linking with the communication network, a circuit for linking with a local interconnection network, a circuit for linking together storage units, characterized in that the bus further more provides for the linking of the microprocessor to the segmented EEPROM memory and to the plug-in segmented EEPROM memory which is associated therewith, and in that it furthermore includes an auxiliary circuit containing an autonomous processing unit, a memory and logic means for monitoring, the auxiliary circuit being linked to the microprocessor by the bus and being in its turn linked to the information carrier analysis device, a circuit for monitoring the power supply to the terminal, and to a circuit for interfacing with the keyboard assembly, to a thermal printer, and to a circuit for monitoring opening and closing of a cash till.

8. The gaming terminal of claim 7, wherein the means for monitoring the power supply to the terminal include an integrated-circuit passkey housing linked, hand to the central unit of the microprocessor and to the segmented EEPROM memory and, to a logic circuit for controlling a switch from the supply to the supply circuit, the logic circuit being moreover linked to the central unit of the microprocessor and receiving therefrom signals indicating the exactness or inexactness of the code contained in the integrated circuit of the integrated-circuit passkey.

9. The gaming terminal of claim 7, wherein the circuit for linking storage units provides for the linking of the terminal to at least one multi-media unit.

10. The gaming terminal of claim 1, wherein the keyboard assembly includes a circuit operably connected with the integrated-circuit passkey means, a circuit for controlling a device for reading magnetic codes and optical codes, a circuit for controlling an integrated-circuit card reader, a circuit for controlling liquid-crystal display devices for the player and the retailer.

11. A gaming terminal for use with gaming coupons and receipts, comprising:

means for analyzing information carriers, including a single information carrier analysis device, having means for analyzing signs written by players on the coupons and for reading bar codes representing validation numerals of the receipts, and means for processing the information resulting from the analysis of the information carriers;

nonvolatile storage means for storing terminal instruction data, and for storing gaming data and validation data;

means for verifying the authenticity of the receipts using said validation data;

data display means for displaying gaming information and instructions to the player and a retailer;

integrated-circuit passkey means for controlling an on-off circuit of the terminal and for permitting and prohibiting access to the terminal, wherein said passkey means defensively disables the terminal in response to an attempted access with an improperly coded passkey, until the retailer with a properly coded passkey reactivates the terminal; and terminal processing means operably connected to a keyboard assembly, the means for analyzing information carriers, the means for verifying, the nonvolatile storage means, the data display means, and the integrated-circuit passkey means for controlling the terminal.

12. The gaming terminal of claim 11, wherein the nonvolatile storage means comprises a segmented EEPROM memory of the "Flash" type.

13. The gaming terminal of claim 12, wherein the nonvolatile storage means further comprises a plug-in segmented EEPROM memory operably coupled with the "Flash" type memory, for storing the terminal instruction data and the gaming data and for enabling the data to be manually transported to a remote processing system.

* * * * *